US011001929B2

(12) United States Patent
Utsumi et al.

(10) Patent No.: US 11,001,929 B2
(45) Date of Patent: May 11, 2021

(54) SURFACE TREATING APPARATUS

(71) Applicant: C. Uyemura & Co., Ltd., Osaka (JP)

(72) Inventors: Masayuki Utsumi, Osaka (JP); Nobuhiko Naka, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 16/680,693

(22) Filed: Nov. 12, 2019

(65) Prior Publication Data

US 2020/0080204 A1 Mar. 12, 2020

Related U.S. Application Data

(62) Division of application No. 15/696,499, filed on Sep. 6, 2017, now Pat. No. 10,513,779.

(30) Foreign Application Priority Data

Oct. 11, 2016 (JP) ..... 2016-200110

(51) Int. Cl.
*C23C 18/38* (2006.01)
*C23C 18/16* (2006.01)
(Continued)

(52) U.S. Cl.
CPC ..... *C23C 18/38* (2013.01); *B05C 5/004* (2013.01); *B05C 5/007* (2013.01); *B05C 5/008* (2013.01);
(Continued)

(58) Field of Classification Search
None
See application file for complete search history.

(56) References Cited

U.S. PATENT DOCUMENTS 2,750,923 A * 6/1956 Marvin ..... B65G 49/0418 118/423
3,721,379 A 3/1973 Corsaro
(Continued)

FOREIGN PATENT DOCUMENTS

CN 103628049 A 3/2014
CN 103789816 A 5/2014
(Continued)

OTHER PUBLICATIONS

Office Action (Including Translation) for Korean Application No. 10-2017-0095922, dated Jul. 1, 2020.
(Continued)

*Primary Examiner* — Jethro M. Pence
(74) *Attorney, Agent, or Firm* — Jason H. Vick; Sheridan Ross, PC

(57) ABSTRACT

To provide surface treatment that can reduce occurrence of defects caused by incorporation of dust. Rollers 40 are rotatably fixed to rotating shafts 72 provided to protrude from lateral protective walls 49. The lateral protective walls 49 are fixed perpendicularly to lower protective walls 47 fixed to outer walls 39. Hanging plates 64 of a hanger 50 extend through a space 43 between both lower protective walls 47 and support clips 52. A liquid 41, such as water, is filled in spaces defined by the lateral protective walls 49, the lower protective walls 47, and the outer walls 39. The liquid 41 is filled to cover about half of each rotating shaft 72. Thus, fine dust generated by a transferring mechanism is captured by the liquid 41 and prevented from drifting from the space 34 toward the substrate 54.

11 Claims, 25 Drawing Sheets

(51) Int. Cl.
*B05C 5/00* (2006.01)
*B05C 5/02* (2006.01)

(52) U.S. Cl.
CPC ..... *B05C 5/02* (2013.01); *C23C 18/163* (2013.01); *C23C 18/1619* (2013.01); *C23C 18/1632* (2013.01)

(56) References Cited

U.S. PATENT DOCUMENTS

| | | | | |
|---|---|---|---|---|
| 5,011,635 | A | 4/1991 | Murphy et al. | |
| 5,045,353 | A * | 9/1991 | Takada | B05C 3/04 427/243 |
| 9,120,113 | B2 | 9/2015 | Hotta et al. | |
| 9,359,676 | B2 | 6/2016 | Hotta et al. | |
| 2014/0053774 | A1 | 2/2014 | Hotta et al. | |
| 2014/0116334 | A1 | 5/2014 | Hotta et al. | |
| 2018/0100237 | A1 | 4/2018 | Utsumi et al. | |

FOREIGN PATENT DOCUMENTS

| | | |
|---|---|---|
| JP | 2006-111946 | 4/2006 |
| JP | 2012-041590 | 3/2012 |
| JP | 2014-043613 | 3/2014 |
| JP | 2014-088600 | 5/2014 |
| KR | 10-2014-0027876 | 3/2014 |

OTHER PUBLICATIONS

First Notification of Office Action (Including Translation) for Chinese Patent Application No. 201710827420.0, dated May 9, 2020.
Notification of Reasons for Refusal (Including Translation) for Japanese Patent Application No. 2016-200110, dated Aug. 20, 2018.
Official Action (Including Translation) for corresponding Taiwan Patent Application No. 106121746, dated Aug. 15, 2019.
Office Action (Restriction Requirement) for U.S. Appl. No. 15/696,499, dated Jun. 26, 2018.
Office Action for U.S. Appl. No. 15/696,499, dated Sep. 14, 2018.
Office Action for U.S. Appl. No. 15/696,499, dated Mar. 12, 2019.
Notice of Allowance for U.S. Appl. No. 15/696,499, dated Sep. 10, 2019.
Decision of Refusal (Including Translation) for Korean Application No. 10-2017-0095922, dated Dec. 14, 2020.

* cited by examiner

SURFACE TREATING APPARATUS

CROSS REFERENCE TO RELATED APPLICATIONS

This application is a Divisional of U.S. application Ser. No. 15/696,499, filed Sep. 6, 2017, now U.S. Pat. No. 10,513,799, which claims the benefit under 35 U.S.C. 119(a) to Japanese Patent Application No. JP 2016-200110, filed Oct. 11, 2016, the entire disclosure of each are incorporated herein by reference in their entirety.

BACKGROUND OF THE INVENTION

1. Field of the Invention

This invention relates to a technology to perform surface treatment on works such as thin plates.

2. Description of the Related Art

When surface treatment such as plating is performed on a substrate or the like, it is generally carried out by immersing the substrate into a plating bath filled with a plating solution. This method requires an elevating mechanism by which the substrate is moved up and down, causing complication and size increase of the apparatus. In addition, filling a plating bath with a plating solution requires a large amount of plating solution. Such problems occur not only in plating but also in surface treatment in general.

To solve such problems, the inventors have invented an apparatus in which a treatment solution is discharged onto a substrate held at an upper part and the treatment solution dropped from the substrate is recovered and discharged again (JP-A-201488600, JP JP-A-201443613 and JP-A-201241590).

FIG. 23 shows a transverse cross-section of a surface treating apparatus described in JP-A-201488600. An upper part of a substrate 2 is pinched by a hanger 6 as a holding member. Roller receiving members 40 and 42 are provided outside a bath 4. A mobile body 14 holding the hanger 6 is held and moved in a direction perpendicular to the plane of the drawing by rollers 16.

The substrate 2 is introduced into the bath 4. In the bath 4, treatment solution releasing sections 8 having treatment solution jet ports 10 are provided on both sides of the substrate 2. A treatment solution is ejected from the treatment solution jet ports 10 onto the substrate 2. The treatment solution having reached the substrate 2 flows down the surfaces of the substrate 2. In this way, the surfaces of the substrate 2 are treated by the treatment solution.

The treatment solution having flowed down is recovered into a lower part of the bath 4, and discharged from the treatment solution releasing sections 8 again by a pump 12.

FIG. 24 shows a plan view. The substrate 2 held by the hanger 6 is transported from a loading section 22 through a first cleaning section 24, a desmear section 26, a second cleaning section 28, a pretreatment section 30, a third cleaning section 32, an electroless copper plating section 34 and a fourth cleaning section 36 to an unloading section 38, where it is removed from the hanger 6.

While each bath has the same transverse cross-section as that shown in FIG. 23, the treatment solution ejected from the treatment solution jet ports 10 differs depending on the baths. As shown in FIG. 24, each bath is open at the top.

In this way, the use of treatment solution can be reduced without complicating and enlarging the apparatus.

In the above related art, the roller receiving members 40 and 42 are provided outside the bath 4, which contributes to enlargement of the apparatus. On the other hand, if the roller receiving members 40 and 42 are provided inside the bath 4, dust generated from movable parts such as rollers 16 and gears (not shown) for driving the rollers 16 may fall into the bath 4. When an extremely fine pattern (a pattern with a width of a few μm) is formed on a substrate by plating, dust that is a few μm in size can cause a defect if adhering to a surface of the substrate. Thus, providing the roller receiving members 40 inside the bath 4 is not practical.

In addition, even when the roller receiving members 40 and 42 are provided outside the bath 4 as in the conventional apparatus, there is still a possibility that generated dust floats and enters the bath 4.

Patent Document 3 discloses a system for removing fine foreign matters incorporated into a treatment solution. It is, however, does not provide a fundamental solution for preventing fine foreign matters from getting into the treatment solution.

The problems as above occur not only in a treatment bath with a structure as shown in FIG. 23 but also in a treatment bath in which a substrate is immersed in a treatment solution for surface treatment.

It is, therefore, an object of this invention to provide a surface treating apparatus that can solve any of the above problems to reduce occurrence of defects caused by dust.

SUMMARY OF THE INVENTION

Some of the features of the surface treating apparatus according to this invention that are independently applicable are listed below.

(1) A surface treating apparatus according to this invention includes a holding member for holding an upper part of a treatment target; a treatment solution releasing section for discharging a treatment solution onto the holding member or the treatment target to allow the treatment solution to flow over a surface of the treatment target held by the holding member; an upper supporting member for supporting the holding member from above; a transferring mechanism for moving the upper supporting member; and protective members provided at least below the transferring mechanism, in which the upper supporting member supports the holding member through a part where no protective member is provided.

Thus, because the protective wall members can limit migration of dust to the treatment target, defects in surface treatment caused by dust can be reduced.

(2) A feature of the surface treating apparatus according to this invention is that it further includes additional protective members provided on both sides of the transferring mechanism.

Thus, the protective members provided on both sides of the transferring mechanism can further limit migration of dust to the treatment target.

(3) Another feature of the surface treating apparatus according to this invention is that a liquid is filled in a space defined by the protective members so that a lower part of the transferring mechanism or at least a part of the transferring mechanism can be immersed in the liquid.

Thus, dust is captured by the liquid and migration of dust to the treatment target can be limited.

(4) Another feature of the surface treating apparatus according to this invention is that a water supply port and a water drain port are provided in the space defined by the protective members so that the liquid can be replaced.

Thus, liquid containing dust can be replaced at any time and the dust-capture effect of the liquid can be maintained.

(5) Another feature of the surface treating apparatus according to this invention is that the transferring mechanism is formed of stainless, titanium, carbon steel, brass or plastic.

Thus, the possibility of corrosion of the transferring mechanism caused by the liquid can be reduced.

(6) A surface treating apparatus according to this invention includes a holding member for holding an upper part of a treatment target; a treatment bath in which a treatment target held by the holding member is immersed in a treatment solution; an upper supporting member for supporting the holding member from above; a transferring mechanism for moving the upper supporting member; and protective walls provided at least below the transferring mechanism, in which the upper supporting member supports the holding member through a part where no protective member is provided.

Thus, because the protective wall members can limit migration of dust to the treatment target, defects in surface treatment caused by dust can be reduced.

In this invention, the term "holding member" refers to a member that has a function of holding at least an upper part of a treatment target. In embodiments, treatment solution receiving members 82 fall under this definition.

The term "treatment solution releasing section" refers to a part that has a function of ejecting a treatment solution directly or indirectly onto a treatment target. In embodiments, pipes 56 and slopes 53 fall under this definition.

The term "upper supporting member" refers to a member that has a function of holding at least a holding member from above. In embodiments, a top plate 62, hanging plates 64, a clip holding member 74, and clips 52 fall under this definition.

The term "transferring mechanism" refers to a mechanism that has a function of moving at least the upper supporting member. In embodiments, rollers 40 and roller guides 66, a pinion 70, and a rack 68 fall under this definition.

The term "protective members" refers to members that have a function of preventing dust generated or stirred up at least by the transferring mechanism from reaching the treatment target. In embodiments, lower protective walls 47 and lateral protective walls 49 fall under this definition.

The features of the present invention can be described broadly as set forth above. The structures and characteristics of the present invention will be apparent from the following detailed description of the invention together with those features, effects, and drawings.

DESCRIPTION OF THE PREFERRED EMBODIMENTS

1. First Embodiment

Figure 1:
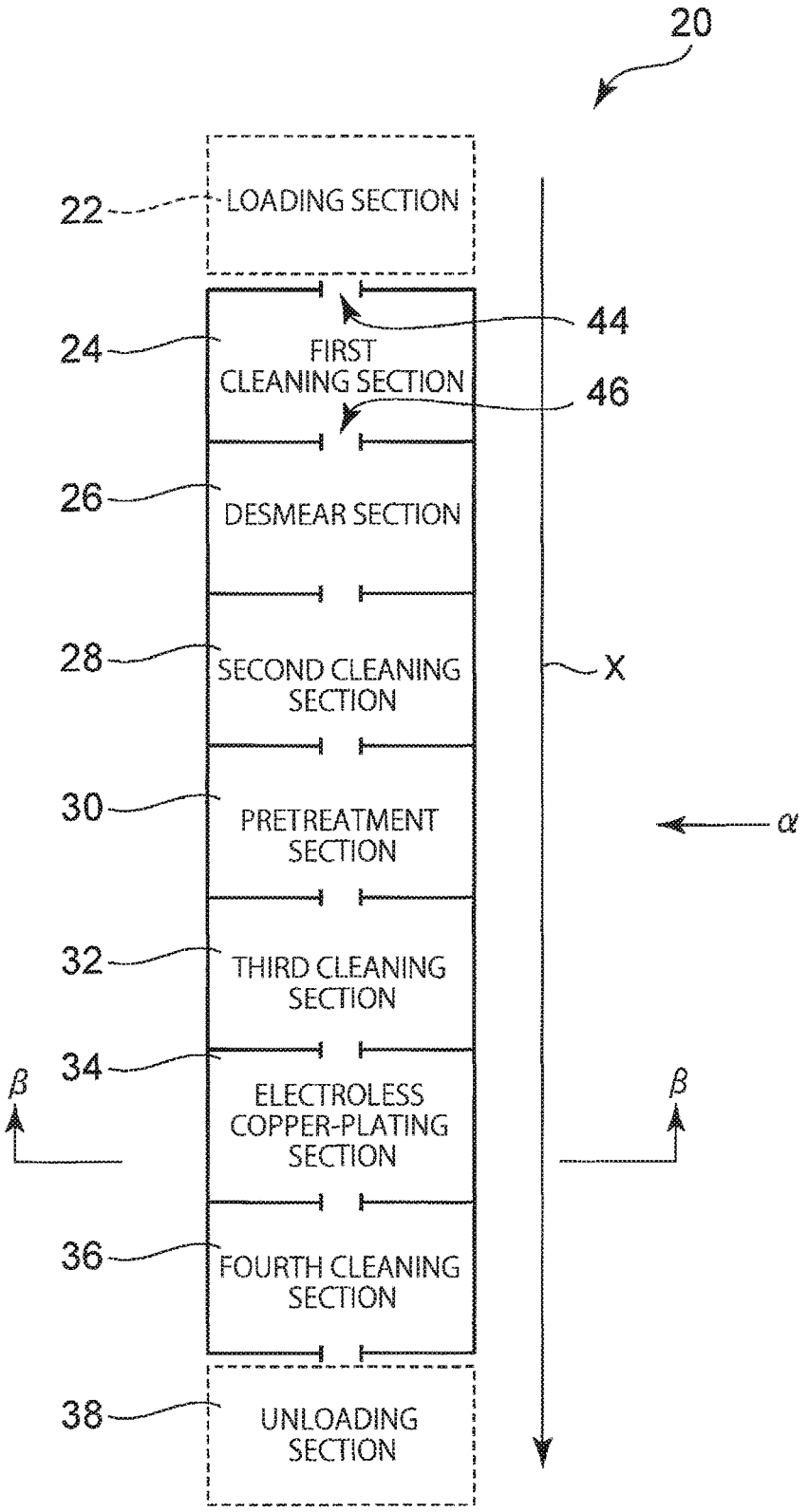
FIG. 1 is an entire configuration diagram of a surface treating system according to one embodiment of this invention.

FIG. 1 shows a plan view of a surface treating system 20 according to an embodiment of this invention. This surface treating system 20 includes a plurality of surface treatment sections. In other words, the surface treating system 20 includes a first cleaning section 24, a desmear section 26, a second cleaning section 28, a pretreatment section 30, a third cleaning section 32, an electroless copper plating section 34, and a fourth cleaning section 36. Each treatment section has an inlet 44 and an outlet 46 through which substrates are moved in the X-direction.

Figure 2:
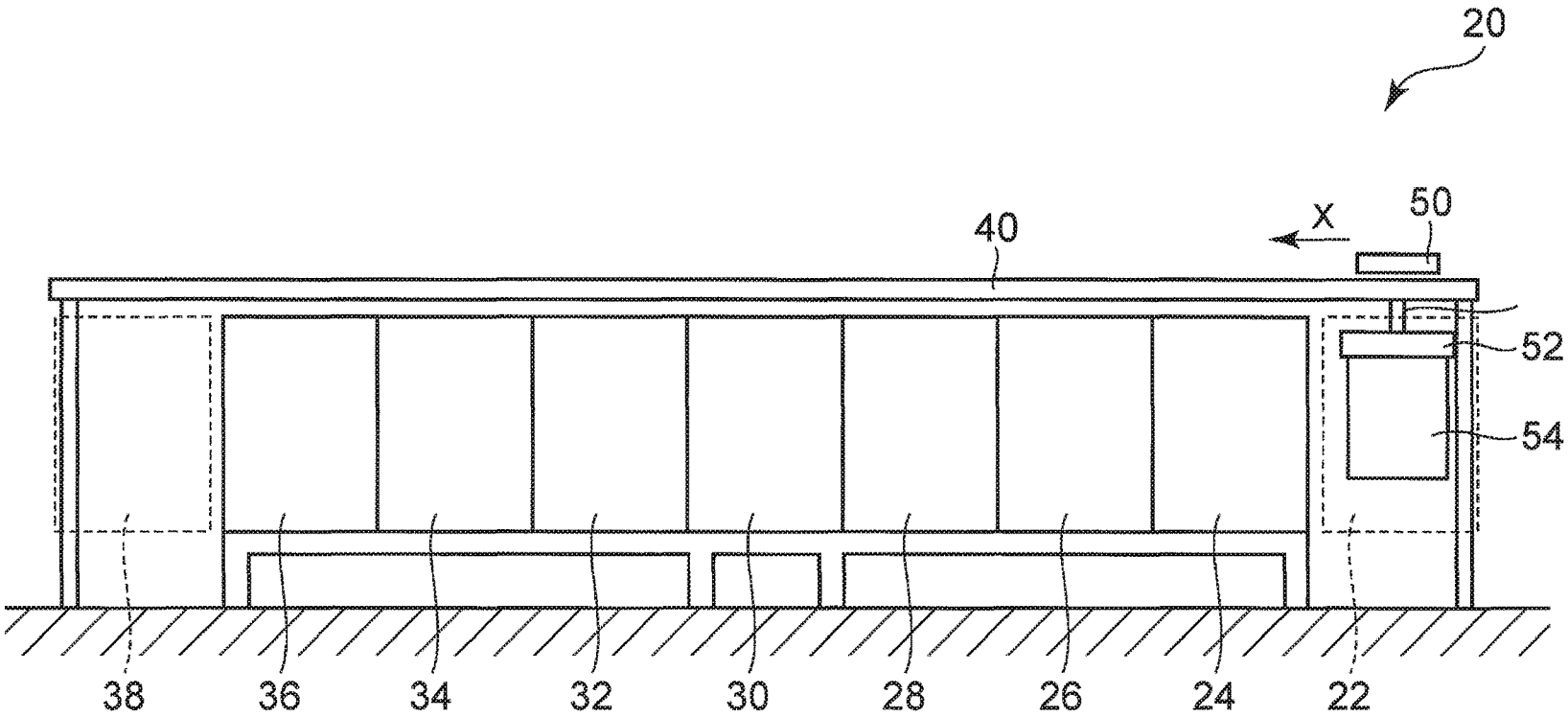
FIG. 2 is a side view of the surface treating system.

FIG. 2 shows a diagram viewed in the α-direction in FIG. 1. A substrate 54 held by clips 52 of a hanger 50 undergoes surface treatment in sequence in the first cleaning section 24, the desmear section 26, the second cleaning section 28, the pretreatment section 30, the third cleaning section 32, the electroless copper plating section 34, and the fourth cleaning section 36.

Figure 3:
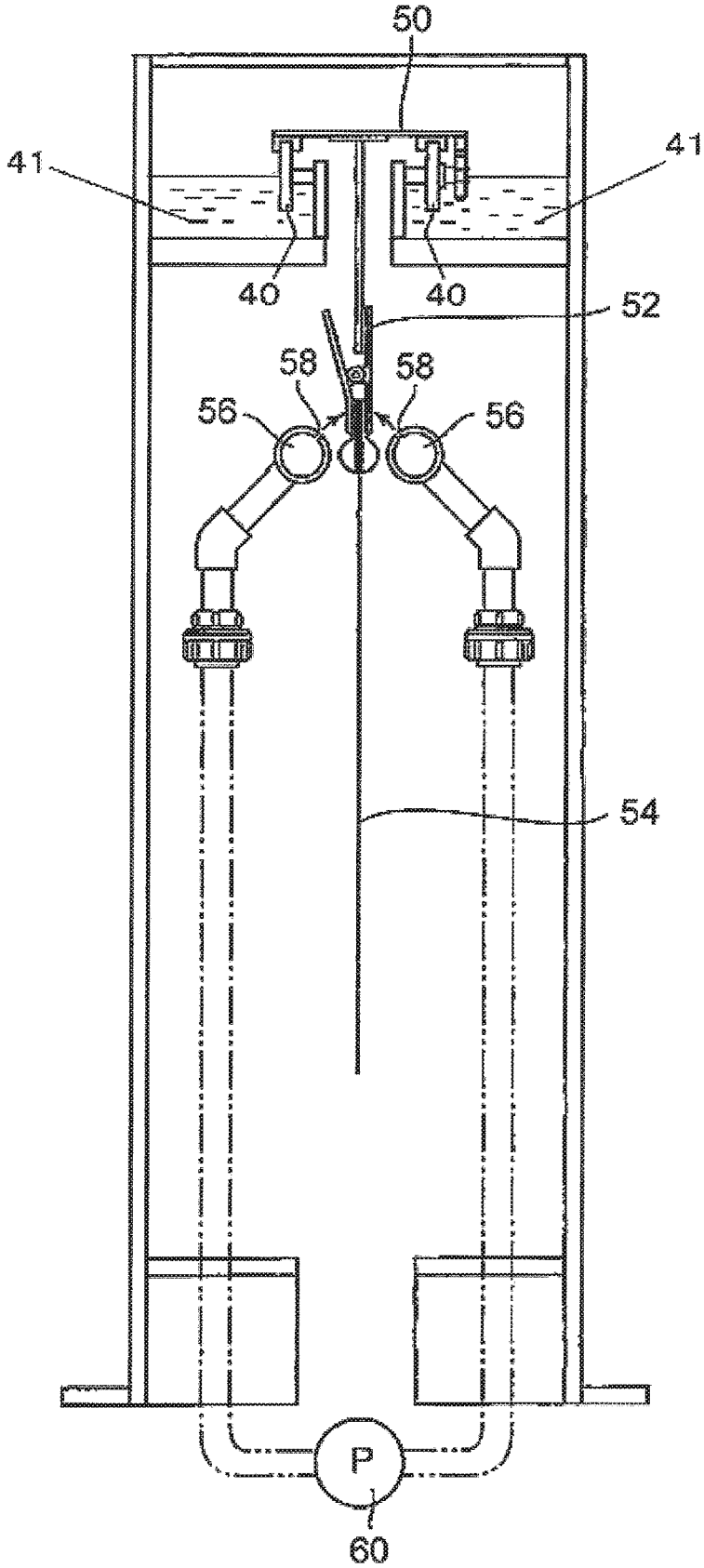
FIG. 3 is a transverse sectional view of the surface treating apparatus.

FIG. 3 shows a cross-sectional view taken along the line β-β in FIG. 1. The substrate 54 is pinched and held at an upper end by the clips 52 of the hanger 50. On both sides of the substrate 54 held by the hanger 50, pipes 56 as treatment solution releasing sections are provided. Each pipe 56 has holes 58 so that a treatment solution can be discharged obliquely upward. The discharged treatment solution flows down the surfaces of the substrate 54 and reaches the bottom, and is circulated and discharged from the pipes 56 again by a pump 60.

Figure 4:
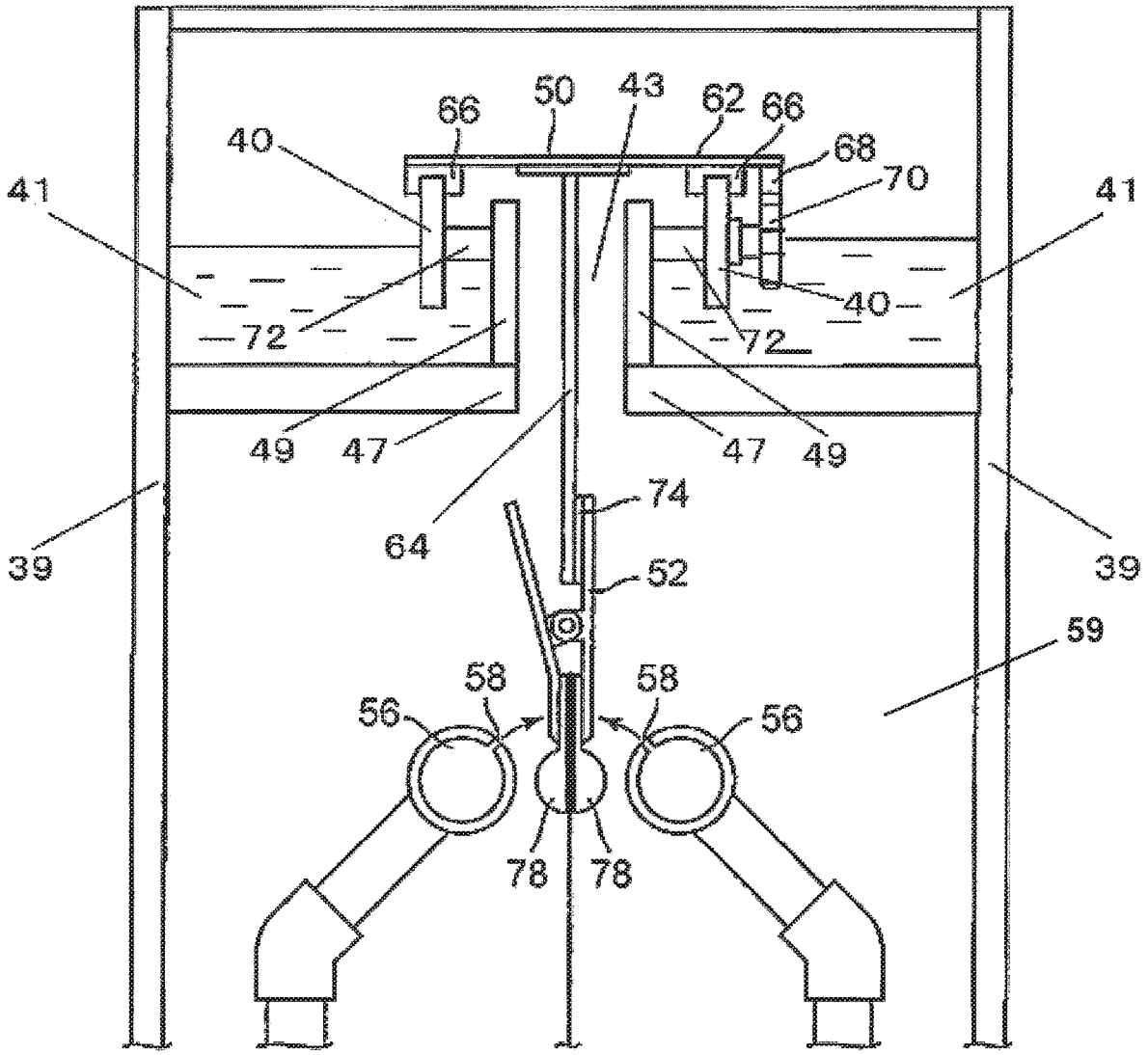
FIG. 4 is a detailed view of a vicinity of a hanger 50.

FIG. 4 shows details of a vicinity of the hanger 50. The hanger 50 includes a top plate 62, hanging plates 64 extending downward from the top plate 62, and a clip holding member 74 fixed to the hanging plates 64. The clips 52 are provided on the clip holding member 74. In this embodiment, an upper supporting member is constituted by the top plate 62, the hanging plates 64, the clip holding member 74, and the clips 52.

Figure 5:
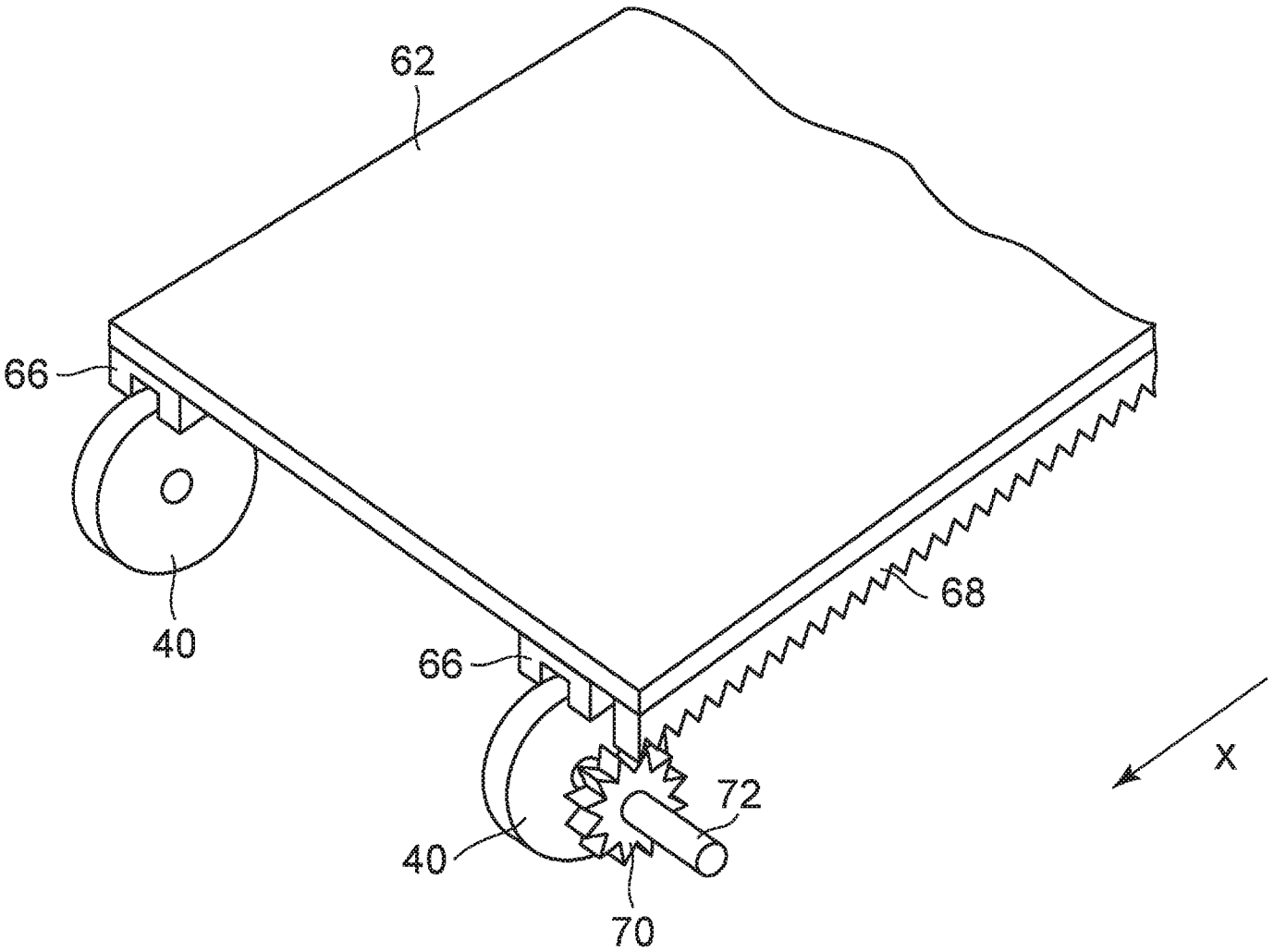
FIG. 5 is a diagram illustrating roller guides 66 and a rack 68 of a top plate 62.

As shown in FIG. 5, roller guides 66 are provided along opposite ends of the top plate 62 on the lower reverse side thereof. In addition, a rack 68 is provided along one end. Each roller guide 66 has a recess in which a roller 40 is rotatably fitted. A pinion 70 is provided on the same rotating shaft 72 as that on which one of the rollers 40 is mounted, and in meshing engagement with the rack 68. The pinion 70 is driven to rotate by a motor (not shown) to move the top plate 62 in a direction of an arrow X. As a result, the substrate 54 held by the hanger 50 is moved through the treatment sections in sequence. A plurality of rollers 40 and a plurality of pinions 70 are provided at predetermined intervals.

As shown in FIG. 4, the rollers 40 and the pinions 70 are fixed to the rotating shafts 72, which are provided to protrude from lateral protective walls 49 (protective members), so as to rotate with rotation of the rotating shafts 72. The lateral protective walls 49 are fixed perpendicularly to lower protective walls 47 (protective members) fixed to outer walls 39. The hanging plates 64 of the hanger 50 extend through a space 43 between the lower protective walls 47 on both sides and support the clips 52.

In this embodiment, the lower protective walls 47 and the lateral protective walls 49 are provided below and beside, respectively, a transferring mechanism (where two or more components slide on each other) constituted by the rollers 40 and the roller guides 66, and the pinions 70 and the rack 68. Thus, the dust generated by the transferring mechanism can be prevented from migrating toward the substrate 54 held by the clips 52.

Moreover, in this embodiment, a liquid 41, such as water, is filled in spaces defined by the lateral protective walls 49, the lower protective walls 47 and the outer walls 39. The liquid 41 is filled to cover about half of each rotating shaft 72. Thus, fine dust generated by the transferring mechanism is captured by the liquid 41, and can be prevented from wafting in the air and migrating toward the substrate 54 through the space 43.

In this embodiment, in order to prevent corrosion caused by the liquid 41 (water), a plastic is used for the rollers 40, which are less affected by dimensional changes caused by wear, and a stainless material is used for the pinions 70, which must be less susceptible to the effect of dimensional changes caused by wear. Instead of or in conjunction with stainless, a metal such as titanium, carbon steel or brass may be used.

Figure 22:
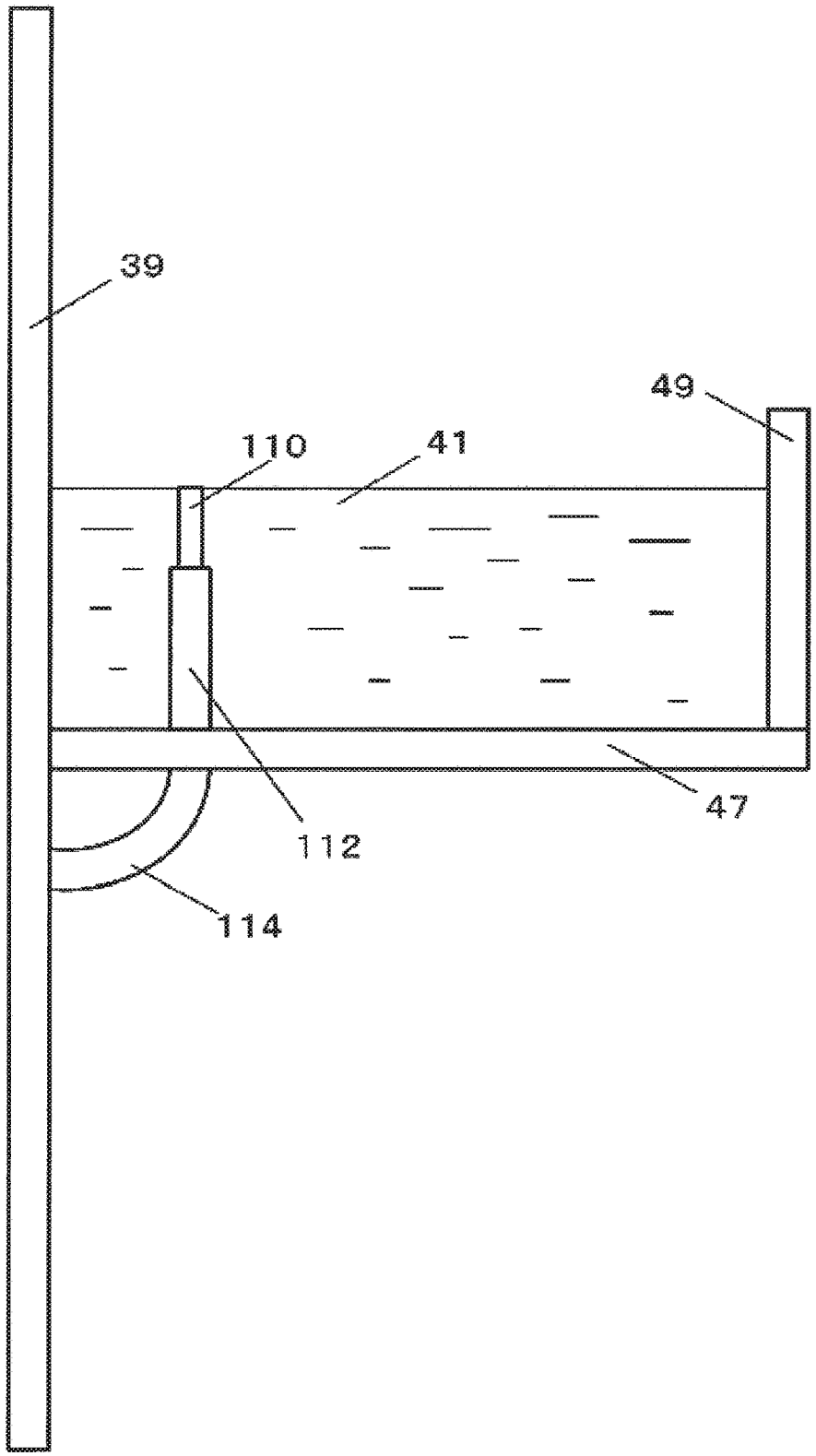
FIG. 22 is a diagram illustrating the structure of a drain port.
Figure 23:
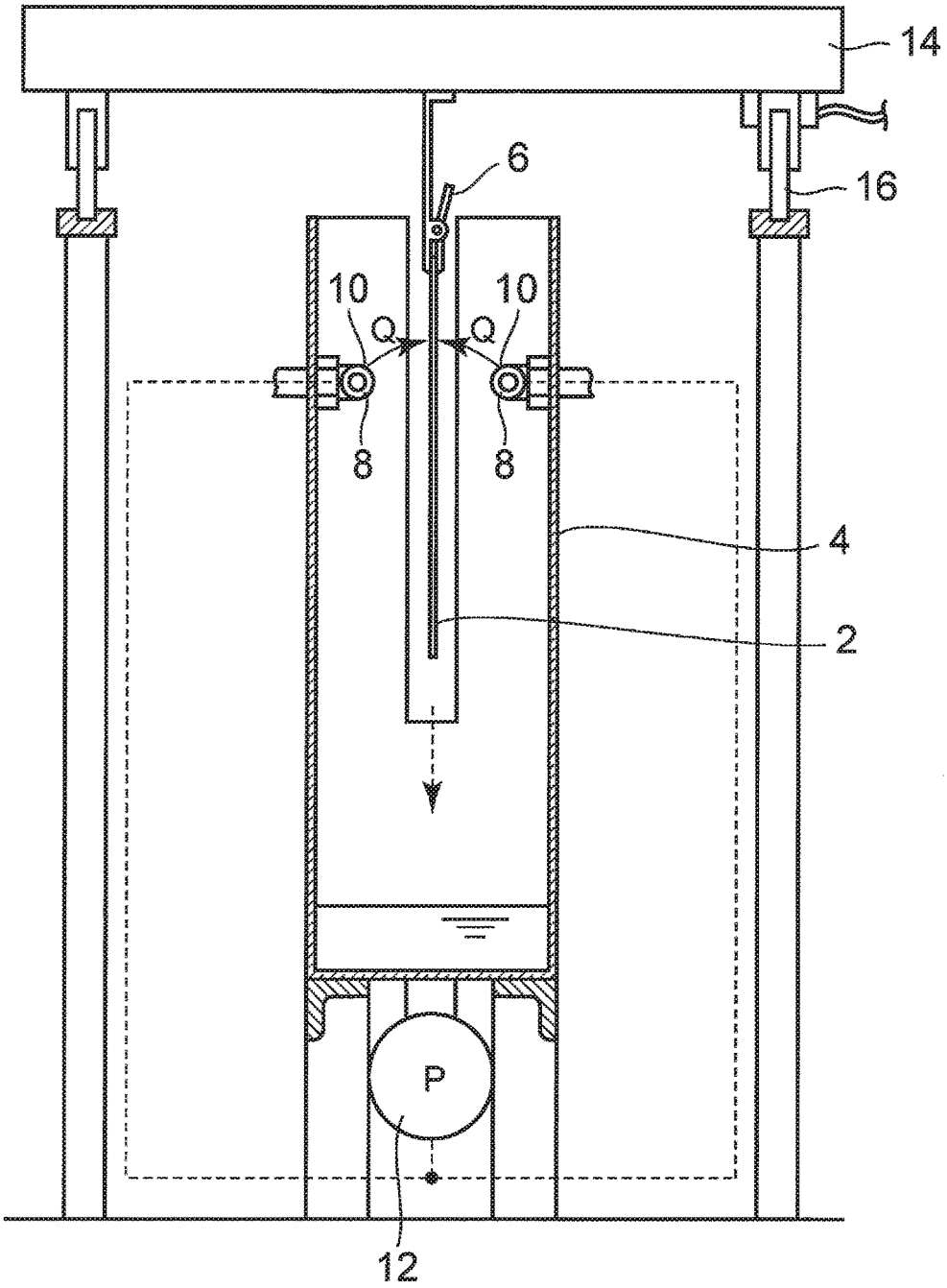
FIG. 23 is a diagram illustrating an example of a conventional surface treating apparatus.
Figure 24:
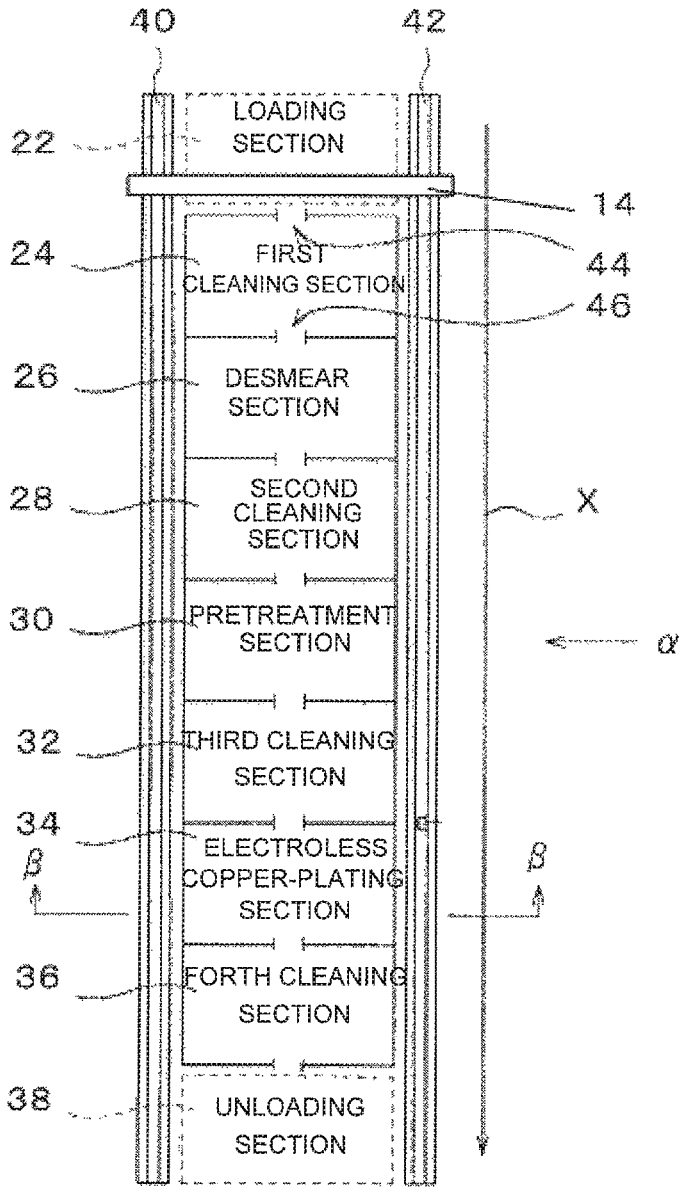
FIG. 24 is a diagram illustrating an example of a conventional surface treating apparatus.

In this embodiment, the liquid 41 is provided to extend from the first cleaning section 24 to the fourth cleaning section 36 (refer to FIG. 1). A water supply port (not shown) is provided on the inlet side of the first cleaning section 24, and a water drain port (not shown) is provided on the outlet side of the fourth cleaning section 36. The configuration of the water drain port is shown in FIG. 22. A base pipe 112 is fixed to the lower protective wall 47 and connected to a drainpipe 114. An adjustment pipe 110 that is movable up and down to adjust its height is inserted into the base pipe 112. The water level of the liquid 41 can be increased or decreased by changing the height of the adjustment pipe 110.

In addition, in this embodiment, the lower protective walls 47 are positioned higher in the vicinity of the water supply port than in the vicinity of the water drain port so that old liquid 41 (the liquid 41 containing dust) can be immediately drained.

Figure 6:
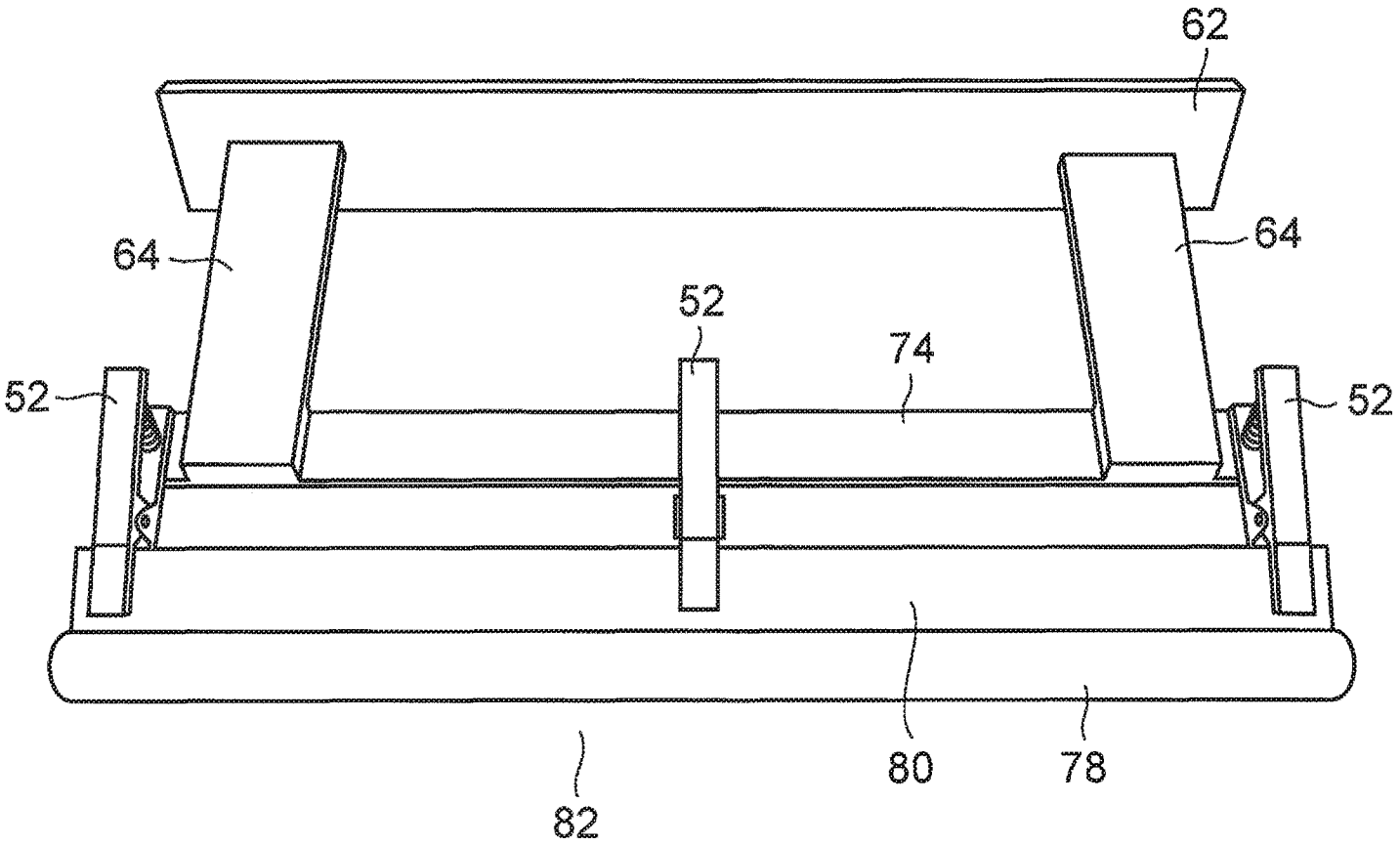
FIG. 6 is a diagram illustrating the hanger 50.

FIG. 6 shows a perspective view of the hanger 50. The hanging plates 64 extend downward from the top plate 62. The clip holding member 74 is fixed laterally to the hanging plate 64. The clips 52 are provided at both ends and center of the clip holding member 74.

Figure 7:
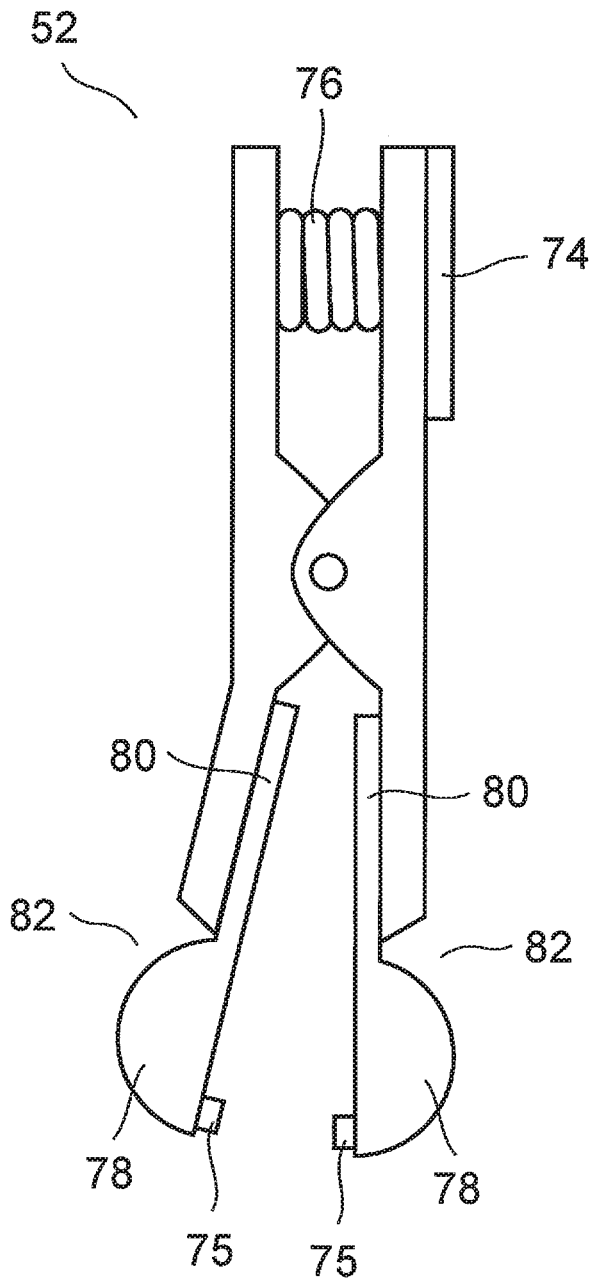
FIG. 7 is a diagram illustrating a clip 52.

FIG. 7 shows details of the clip 52. The clip 52 is biased by a spring 76 in such a direction that the tips of the clip 52 are closed. FIG. 7 shows a state where the tips have been opened by pressing the spring 76 against it. As shown in FIG. 6, treatment solution receiving members 82 (holding members) extending along the entire width of the hanger 50 are provided across the tips of the clips 52. As shown in FIG. 7, each treatment solution receiving member 82 has a flat plate 80 forming a proximal portion thereof, and a projected section 78 raised in a semicircular shape (preferably with a radius of 20 mm to 40 mm) to form a distal portion thereof. Gripping projections 75 for pinching and grasping the substrate 54 are provided along an inner lower end of each projected section 78.

Figure 11A:
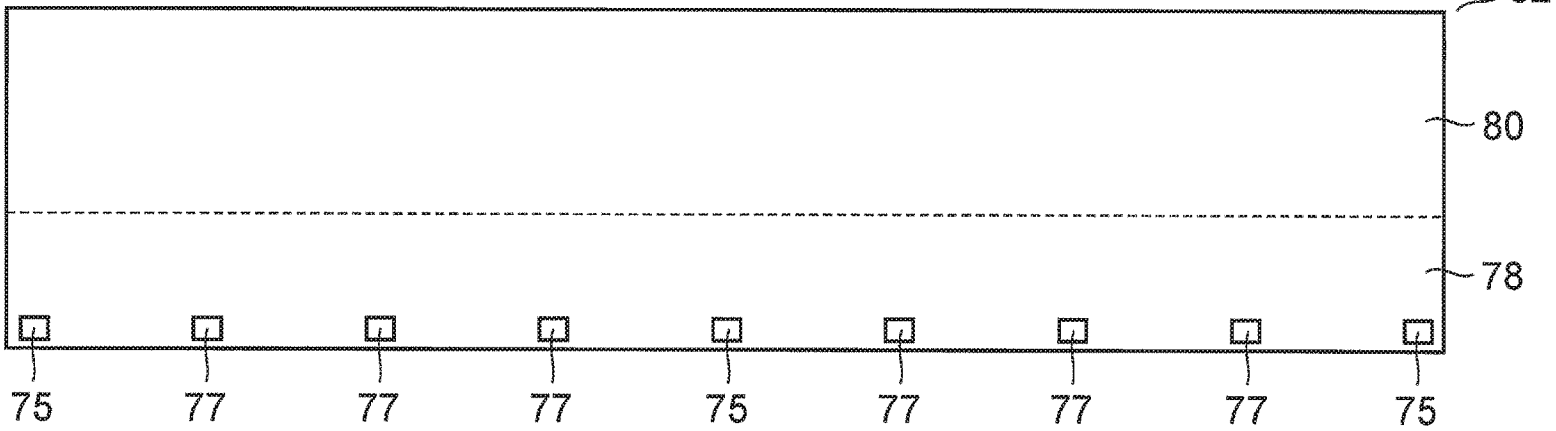
FIG. 11A and FIG. 11B are diagrams illustrating the structure of the inside of the treatment solution receiving member 82.
Figure 11B:
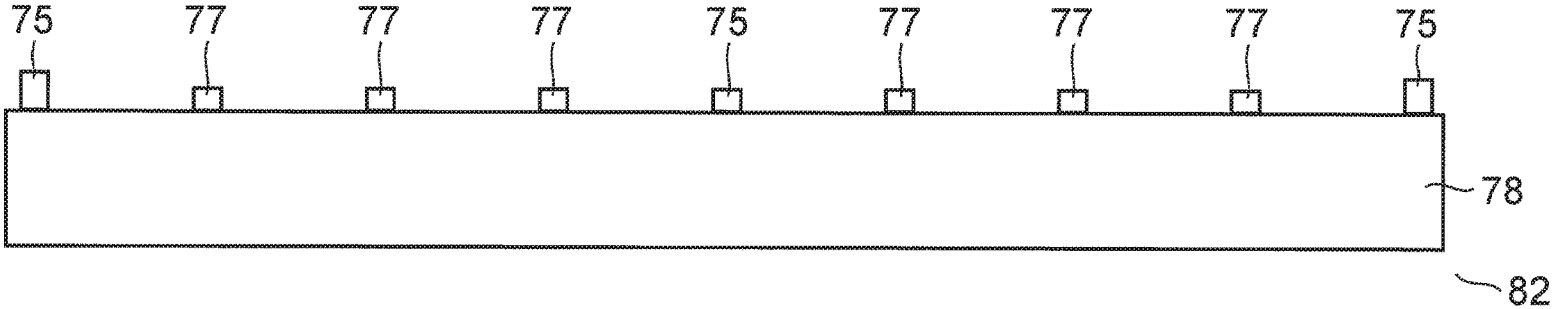

FIG. 11A shows a diagram of the treatment solution receiving member 82 as seen from the inside thereof. In this embodiment, the gripping projections 75 are provided in three positions, at the right and left ends and the center. Adhesion prevention projections 77 are also provided between the gripping projections 75. FIG. 11B is a bottom view of FIG. 11A. As can be seen from this diagram, the adhesion prevention projections 77 are formed lower than the gripping projections 75. Thus, the substrate 54 is pinched and held at an upper end by the gripping projections 75.

The adhesion prevention projections 77 are provided to prevent the substrate 54 from bending at portions without the gripping projections 75 (a thin substrate easily bends) and closely contacting the treatment solution receiving members 82. This is because when the substrate 54 closely contacts the treatment solution receiving members 82 with a large close contact area, the substrate 54 remains in close contact with the treatment solution receiving members 82 and the contact portions do not undergo surface treatment even when the treatment solution flows down onto the substrate 54.

Referring again to FIG. 4, the treatment solution is supplied into the pipes 56 by the pump 60 shown in FIG. 3. The treatment solution differs depending on the treatment sections. In this embodiment, a cleaning liquid is used in the first cleaning section 24, the second cleaning section 28, the third cleaning section 32, and the fourth cleaning section 36. A desmear liquid is used in the desmear section 26. A pretreatment solution is used in the pretreatment section 30. A plating solution is used in the electroless copper plating section 34.

The holes 58 of the pipes 56 are directed upward at a predetermined angle (45 degrees, for example). Thus, the treatment solution is discharged obliquely upward from the pipes 56 and reaches the clips 52. Preferably, the holes 58 are directed at 5 to 85 degrees with respect to a horizontal direction. The holes 58 of the pipes 56 are provided at predetermined intervals (at intervals of 10 cm, for example) in a direction perpendicular to the plane of the drawing.

Figure 8A:
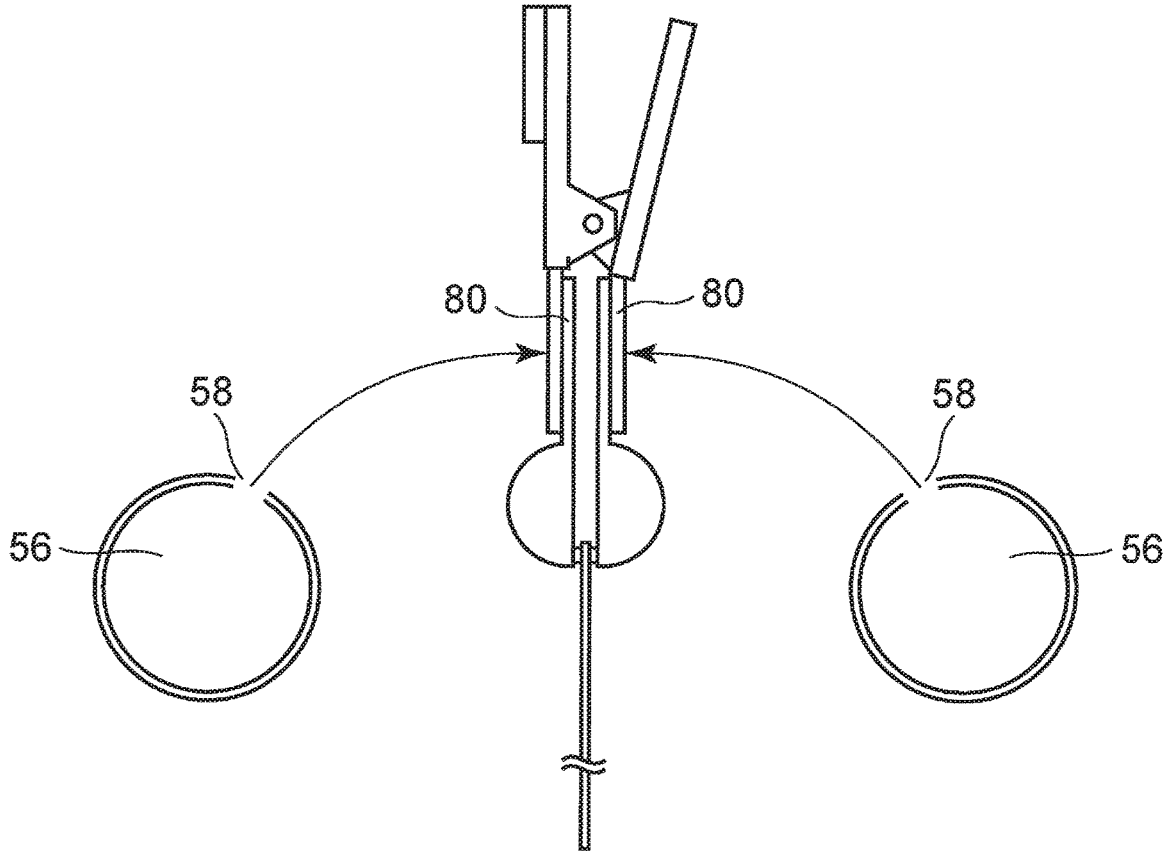
FIG. 8A is a diagram illustrating the state of treatment solution discharged from pipes 56.
Figure 8B:
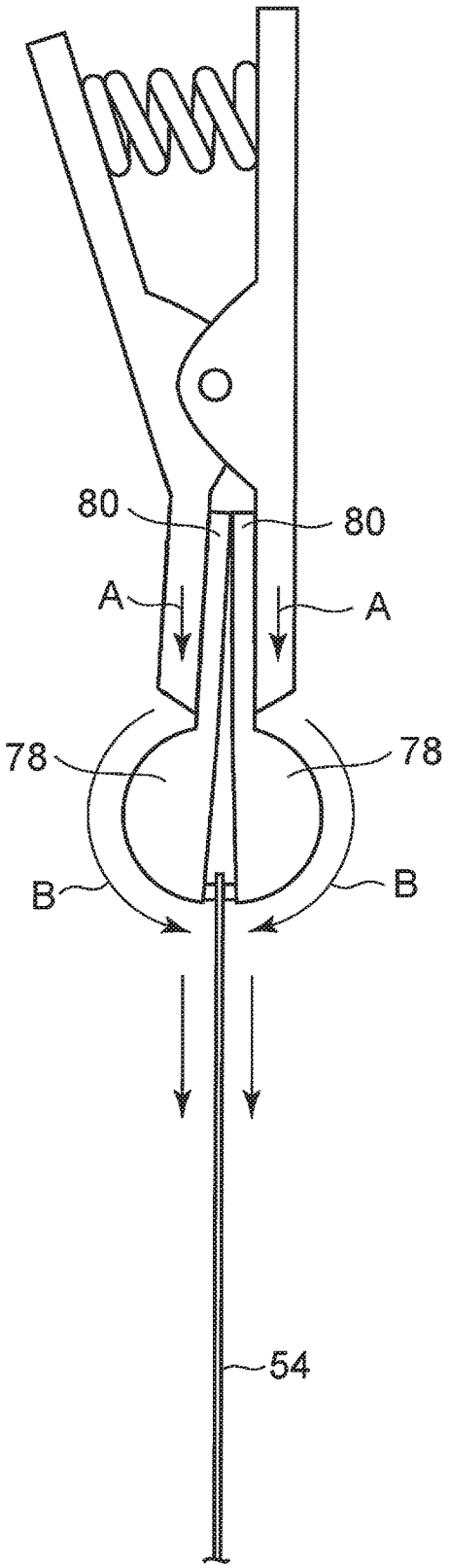
FIG. 8B is a diagram illustrating flows of treatment solution on treatment solution receiving members 82.

As shown in FIG. 8A, the treatment solution ejected from the holes 58 of the pipes 56 contacts the flat plates 80 of the treatment solution receiving members 82 and flows downward. The flow of water at this time is shown in FIG. 8B. The treatment solution having contacted the flat plates 80 spreads to the right and left while flowing on the surfaces of the flat plates 80 in the direction indicated by arrows A (downward). While the treatment solution is discharged at predetermined intervals from the pipes 56 as described above, the treatment solution flows downward on the entire surfaces in the width direction of the flat plates 80 because the treatment solution having contacted the flat plates 80 spreads to the right and left.

The treatment solution having flowed down the surfaces of the flat plates 80 flows down the surfaces of the projected sections 78 with a semicircular cross-sectional shape as indicated by arrows B. The treatment solution having reached the lower end of the projected sections 78 flows down the substrate 54. Thus, the treatment solution flows over the entire surfaces of the substrate 54, whereby surface treatment is achieved.

Figure 9A:
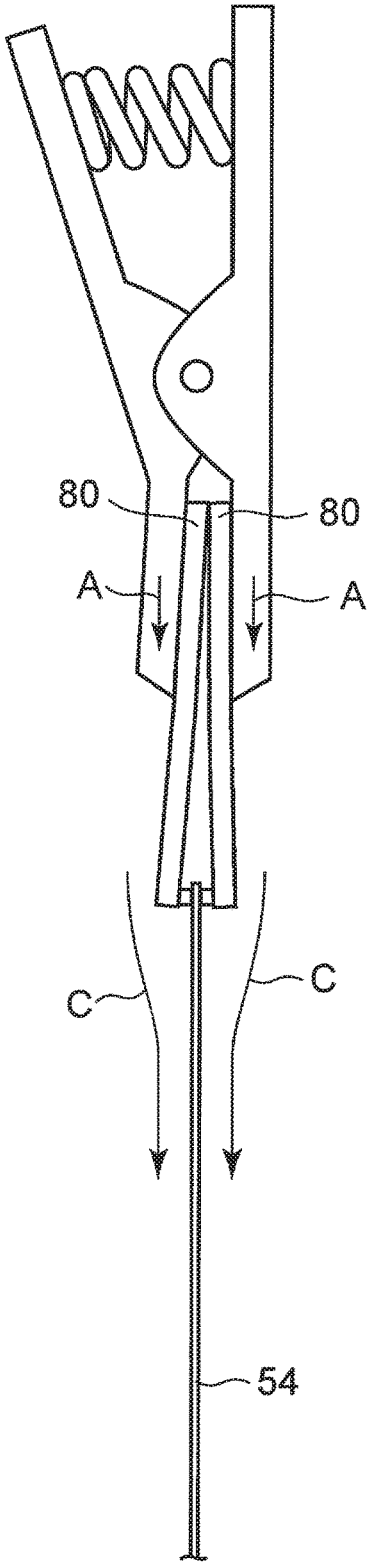
FIG. 9A and FIG. 9B are diagrams illustrating different shapes of the treatment solution receiving members 82.

It is preferred that the treatment solution flow from the treatment solution receiving members 82 onto the substrate 54 at an angle close to a right angle to the surfaces as shown in FIG. 8B. This is because if the treatment solution flows onto the substrate 54 at an angle close to horizontal as shown in FIG. 9A, the agent (such as vanadium used in plating) applied to the surfaces of the substrate 54 may be washed away until appropriate surface treatment cannot be achieved.

Figure 9B:
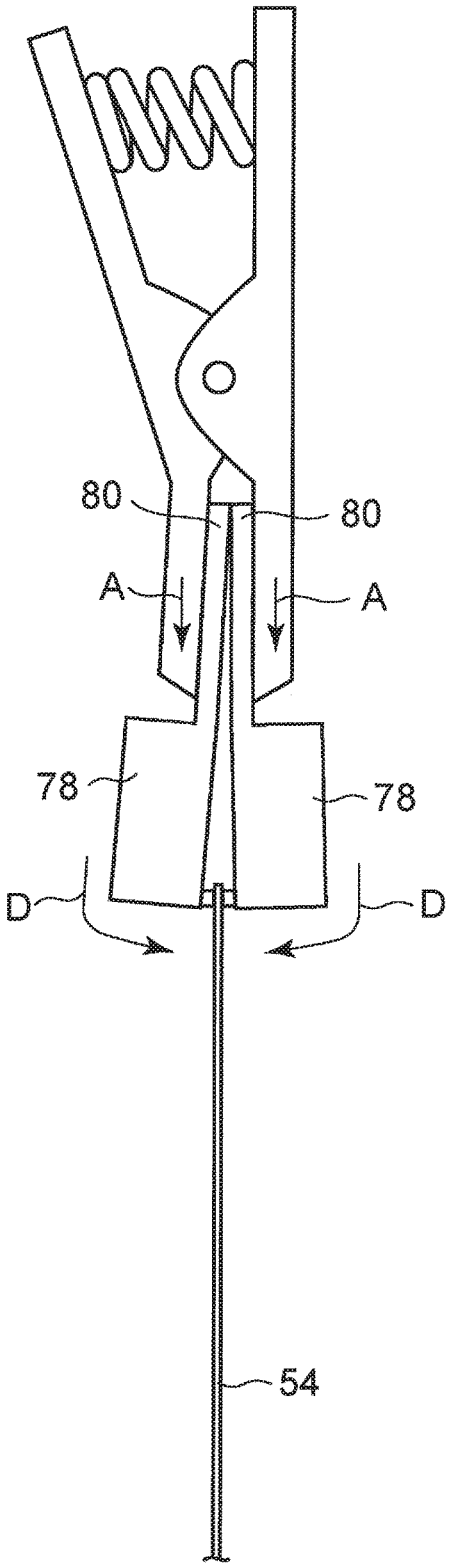

Thus, it is preferred that the projected sections 78 be provided as shown in FIG. 9B so that treatment solution can flow onto the surfaces of the substrate 54 at an angle close to a right angle. However, in a structure as shown in FIG. 9B, the treatment solution may not sufficiently flow around the projected sections 78 at an upper part of the substrate 54, which may result in non-uniform surface treatment. Thus, in the above embodiment, the projected sections 78 are formed to have a round shape (curved shape) to ensure that the treatment solution flows around the projected sections 78 onto the surfaces of the substrate 54 at an angle close to a right angle.

Figure 10A:
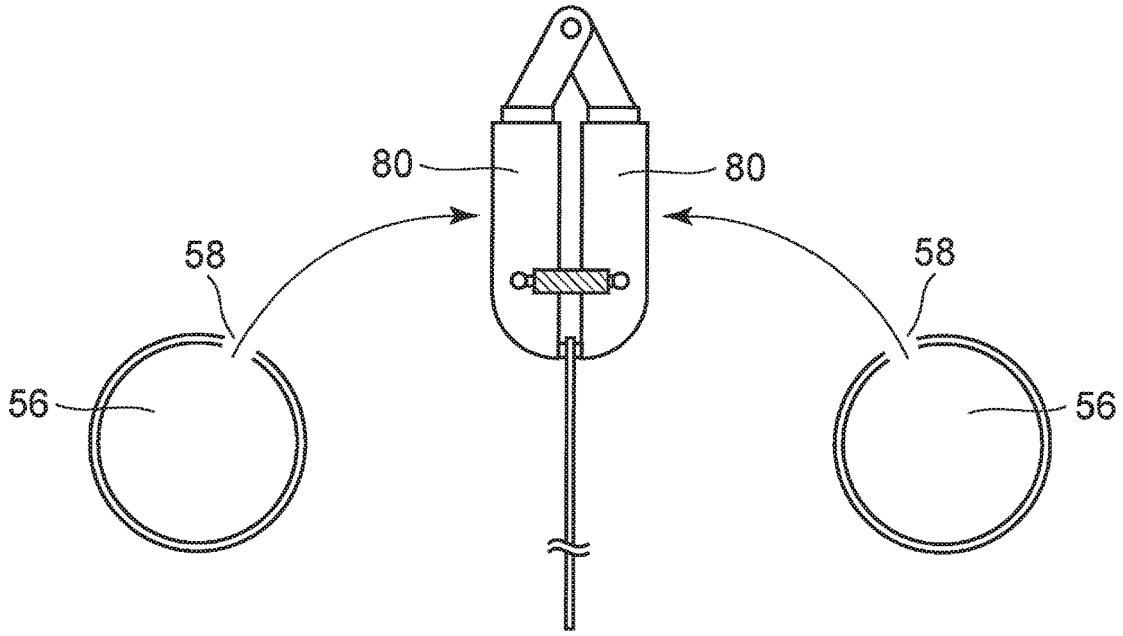
FIG. 10A and FIG. 10B are diagrams illustrating different shapes of the treatment solution receiving members 82.

For example, a similar effect may be achieved by rounding the lower outer edges of the projected sections 78 shown in FIG. 9B. Alternatively, the flat plates 80 may be formed thick (preferably 20 mm to 40 mm) with a rounded outer edge (preferably R=10 mm or greater) as shown in FIG. 10A.

Figure 10B:
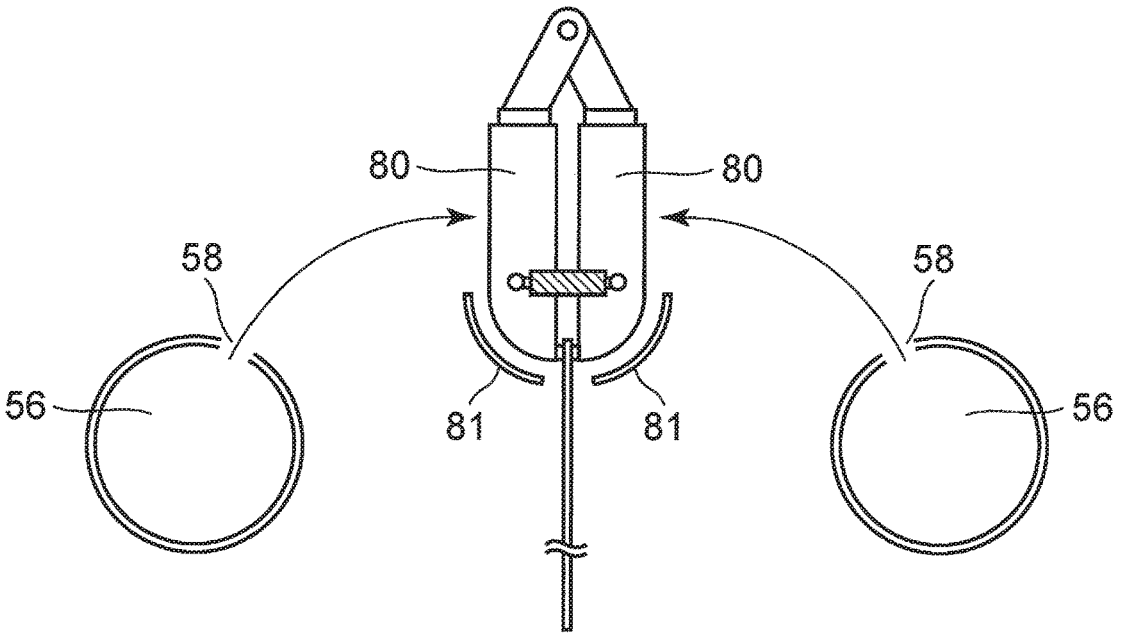

Further, flow guides 81 may be provided as shown in FIG. 10B. The flow guides 81 ensure that the treatment solution flows toward the substrate 54. The use of the flow guides 81 ensures that the treatment solution flows toward the substrate 54 even in a structure as shown in FIG. 9B.

Because the treatment solution flowing onto the substrate 54 also slightly spreads upward in the vicinity of the lower ends of the projected sections 78, the treatment solution reaches up to the upper end of the substrate 54. In this case, because the adhesion prevention projections 77 are provided as shown in FIG. 11B, the substrate 54 does not closely contact the treatment solution receiving members 82 but contacts the treatment solution receiving members 82 only via the adhesion prevention projections 77 even if the substrate 54 is bent. Thus, the inflow of treatment solution floats the substrate 54 from the adhesion prevention projections 77, and, consequently, the substrate 54 undergoes uniform surface treatment up to the upper end.

The adhesion prevention structure as shown in FIG. 11 is also applicable to a method in which a treatment solution is brought into contact with the hanger 50 and allowed to flow down the substrate 54 as well as a method in which a treatment solution is brought into contact with a vicinity of an upper end of the substrate 54 and allowed to flow down the substrate 54.

As shown in FIG. 1, cleaning treatment is performed before (after) the desmear treatment, the pretreatment and the electroless copper plating treatment. In the cleaning treatment, cleaning water as a treatment solution is allowed to flow to wash the surfaces of the substrate 54 in the same manner as described above. In the cleaning treatment, however, the treatment solution discharged from the pipes 56 contacts the flat plates 80 at higher positions than in the desmear treatment, the pretreatment and the electroless copper plating treatment. This enables the cleaning treatment to wash away the desmear treatment solution, the pretreatment solution or the electroless copper plating treatment solution adhering to the flat plates 80 more appropriately.

Figure 12:
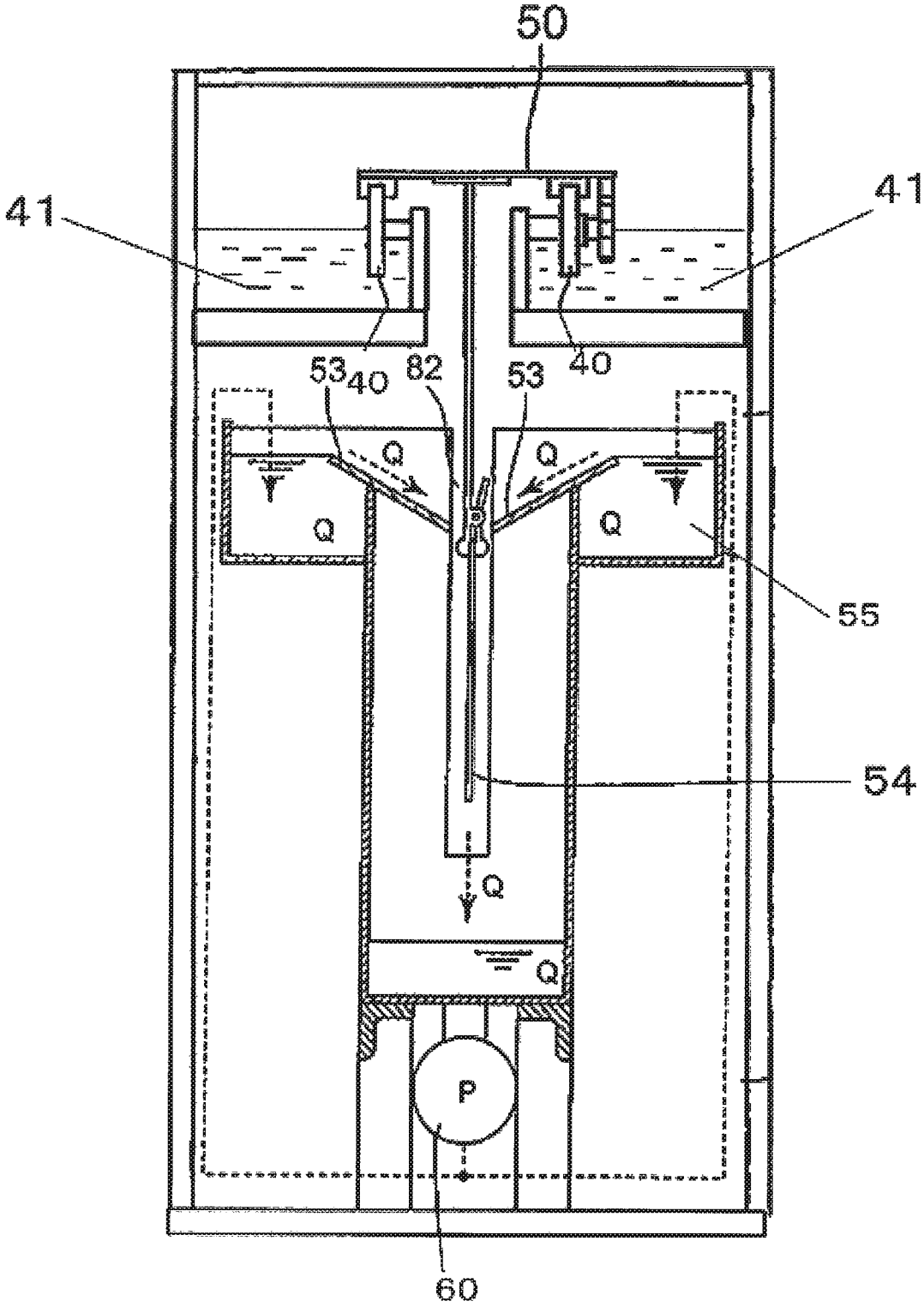
FIG. 12 is a diagram illustrating the structure of treatment solution releasing sections according to another example.

While the treatment solution is discharged obliquely upward from the pipes 56 in the above embodiment, the treatment solution may be discharged obliquely downward from slopes 53 as shown in FIG. 12. The treatment solution pumped up by the pump 60 is stored in reservoirs 55. When the liquid level gets higher than the edges of the slopes 53, the treatment solution overflows onto the slopes 53. The treatment solution having overflowed onto the slopes 53 contacts the treatment solution receiving members 82 and flows down onto the substrate 54. In this case, the slopes 53 correspond to treatment solution releasing sections.

In the above embodiment, a case is described where the present invention is applied to a treatment bath 59 (as shown in FIG. 4) in which a treatment solution is discharged onto the substrate 54. However, the present invention is also applicable to a treatment bath in which the substrate 54 is immersed into a treatment solution. Again, in this case, dust can be prevented from entering the treatment solution to cause a defect.

In the above embodiment, the hanger 50 is configured to move relative to the pipes 56 or the reservoirs 55. However, the hanger 50 may be fixed with the pipes 56 or the reservoirs 55 configured to be movable.

In the above embodiment, the liquid 41 is filled to such a degree that half of each rotating shaft 72 is immersed in the liquid 41. However, a sufficient effect can be achieved only if the liquid 41 is deep enough to contact at least the rollers 40. If possible, the liquid 41 may be filled to such a degree that the entire transferring mechanism is immersed in the liquid 41. Further, even when the liquid 41 is shallow enough not to contact the roller 40, effects can be expected because the dust falling from the transferring mechanism can be captured.

In the above embodiment, the liquid 41 is used. However, the liquid 41 may not be used. Without the liquid 41, the dust preventive effect decreases. Even so, the lateral protective walls 49 and the lower protective walls 47 can prevent the dust generated (stirred up) by the transferring mechanism from migrating toward the substrate 54. In addition, only the lower protective walls 47 may be provided without the lateral protective walls 49. Even in this case, a certain level of dust preventive effect can be expected.

In the above embodiment, the rollers 40 and the pinions 70 are supported by the lateral protective walls 49. However, the rollers 40 and the pinions 70 may be supported by the lower protective walls 47 or the outer walls 39.

In the above embodiment, the roller guides 66 are provided on the top plate 62 side and the rollers 40 are provided on the lateral protective wall 49 side in the hanger 50.

However, the rollers 40 may be provided on the top plate 62 side and the roller guides 66 may be provided on the lateral protective wall 49 side.

In the above embodiment, the rack 68 is provided on the top plate 62 side and the pinions 70 are provided on the lateral protective wall 49 side in the hanger 50. However, the pinions 70 may be provided on the top plate 62 side and the rack 68 may be provided on the lateral protective wall 49 side. While water is used as the liquid in the above embodiment, a lubricating oil or the like may be used.

In the above embodiment, protective walls are used as protective members to physically prevent dust from migrating. However, ions or the like may be generated to adsorb dust electrically or magnetically in order to prevent migration of dust. Alternatively, dust may be caused to repel to prevent dust from migrating toward the substrate 54. Further, a mechanism that sucks dust may be provided.

2. Second Embodiment

In the first embodiment, a structure is shown in which the treatment solution is allowed to flow appropriately on one substrate 54 held by one hanger 50. A second embodiment described below relates to a case where substrates 54 are held by a plurality of hanger 50 and the treatment solution is allowed to flow continuously on the substrates 54.

In the following, a case is described where the structure is applied to the surface treating apparatus of the first embodiment for convenience of description. However, the structure is applicable to any surface treating apparatus in which a treatment solution is allowed to flow over the surfaces of the substrate 54.

Figure 13:
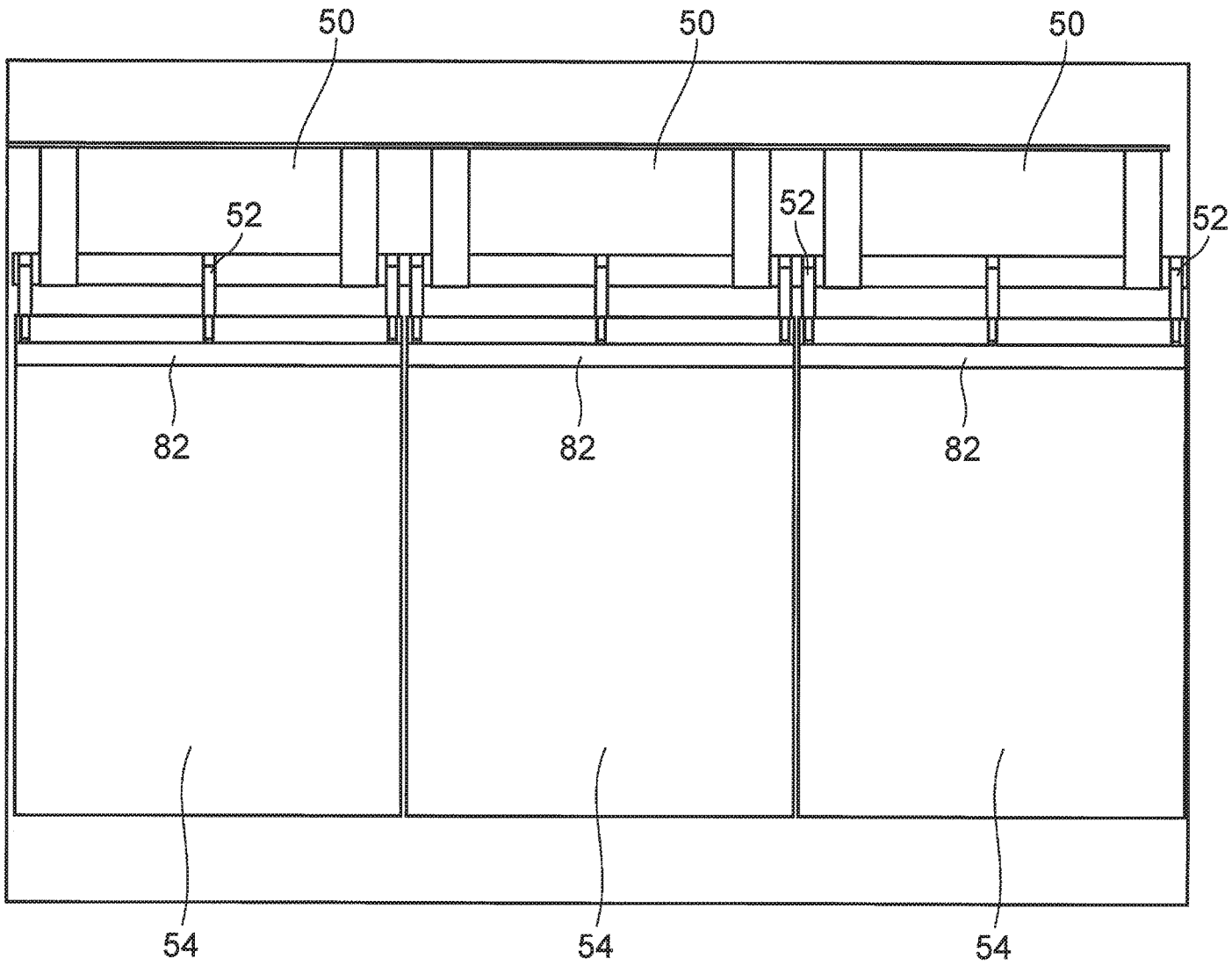
FIG. 13 is a diagram illustrating hangers 50 arranged in series and substrates 54 held thereby.

FIG. 13 shows a state where a plurality of substrates 54 held by the hangers 50 is arranged. Each substrate 54 is held along the width of the corresponding hanger 50. The treatment capacity increases as the distance between adjacent substrates 54 is as small as possible. In this embodiment, a distance of 5 mm to 15 mm is provided between adjacent substrates 54. It is, however, difficult to reduce the distance between the substrate 54 to 0 mm. This is because adjacent substrates 54 may be overlapped or brought into close contact with each other and twisted or torn when an error occurs between the transport speeds of the hangers 50.

A distance of 5 mm to 15 mm is also provided between the hangers 50. This is because there is a possibility that the hangers 50 contact each other and are tilted until adjacent substrates 54 contact each other when the feeding speeds of the hangers 50 are not completely equal to each other. It is matter of course that the distance can be reduced when the feeding speeds of the hangers 50 are maintained precisely equal to each other, but this cannot be realized without a complicated and expensive mechanism. This is the reason why a predetermined distance must be provided between adjacent hangers 50 and between adjacent substrates 54. Essentially, there is no need to allow the treatment solution to flow between the substrates 54 because there is no substrate 54 having surfaces to be treated with the treatment solution.

Figure 14:
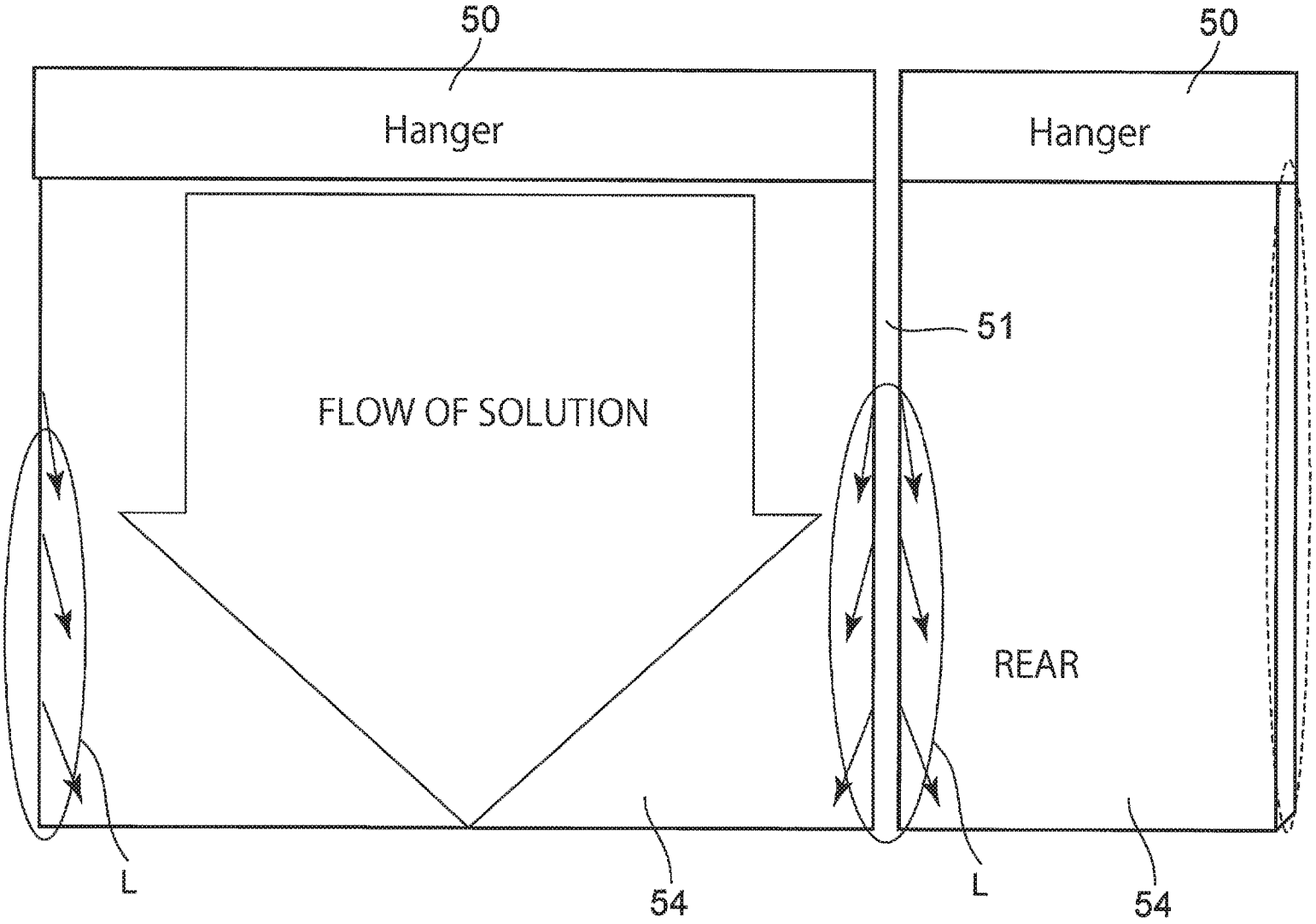
FIG. 14 is a diagram illustrating flows of liquid in FIG. 13.

However, as schematically shown in FIG. 14, because no treatment solution flows in spaces 51 between the hangers 50, the amount of treatment solution that flows along the edges of lower parts L of the substrates 54 decreases due to surface tension. This causes the substrates 54 to undergo non-uniform surface treatment.

Figure 15:
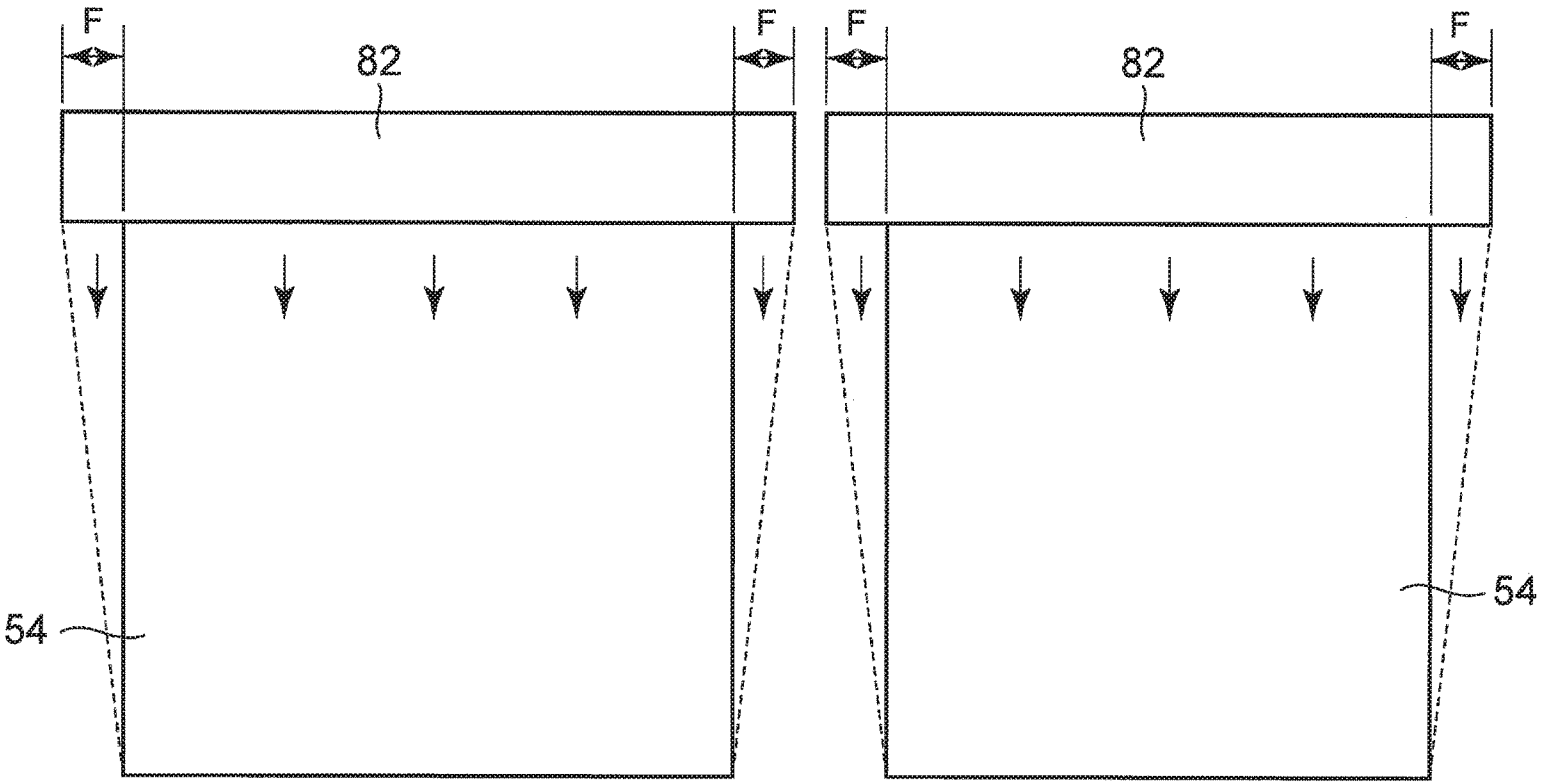
FIG. 15 is a diagram illustrating flows of treatment solution that occur when the hangers 50 are protruded.

To solve the problem, a structure in which the treatment solution flows even in the spaces outside the right and left edges of the substrates 54 is employed in the second embodiment. FIG. 15 shows an example thereof. In this example, the treatment solution receiving members 82 of the hangers 50 have a larger width than the substrates 54. Thus, as indicated by arrows in the diagram, the treatment solution flows even outside the substrates 54. The layers of treatment solution approach the edges of the substrates 54 as the treatment solution flows downward, and are eventually absorbed into the flows on the substrates 54. However, by sufficiently increasing the degree of protrusion F of the treatment solution receiving members 82, layers of treatment solution that extend to the lower ends of the substrates 54 can be formed outside the right and left edges of the substrates 54 (refer to broken lines).

In the structure shown in FIG. 15, however, the distance between substrates 54 is so large that the number of substrates 54 that can be treated per unit time decreases. When the yield of treatment matters, the treatment solution receiving members 82 may be configured to have a structure as shown in FIG. 16.

Figure 16:
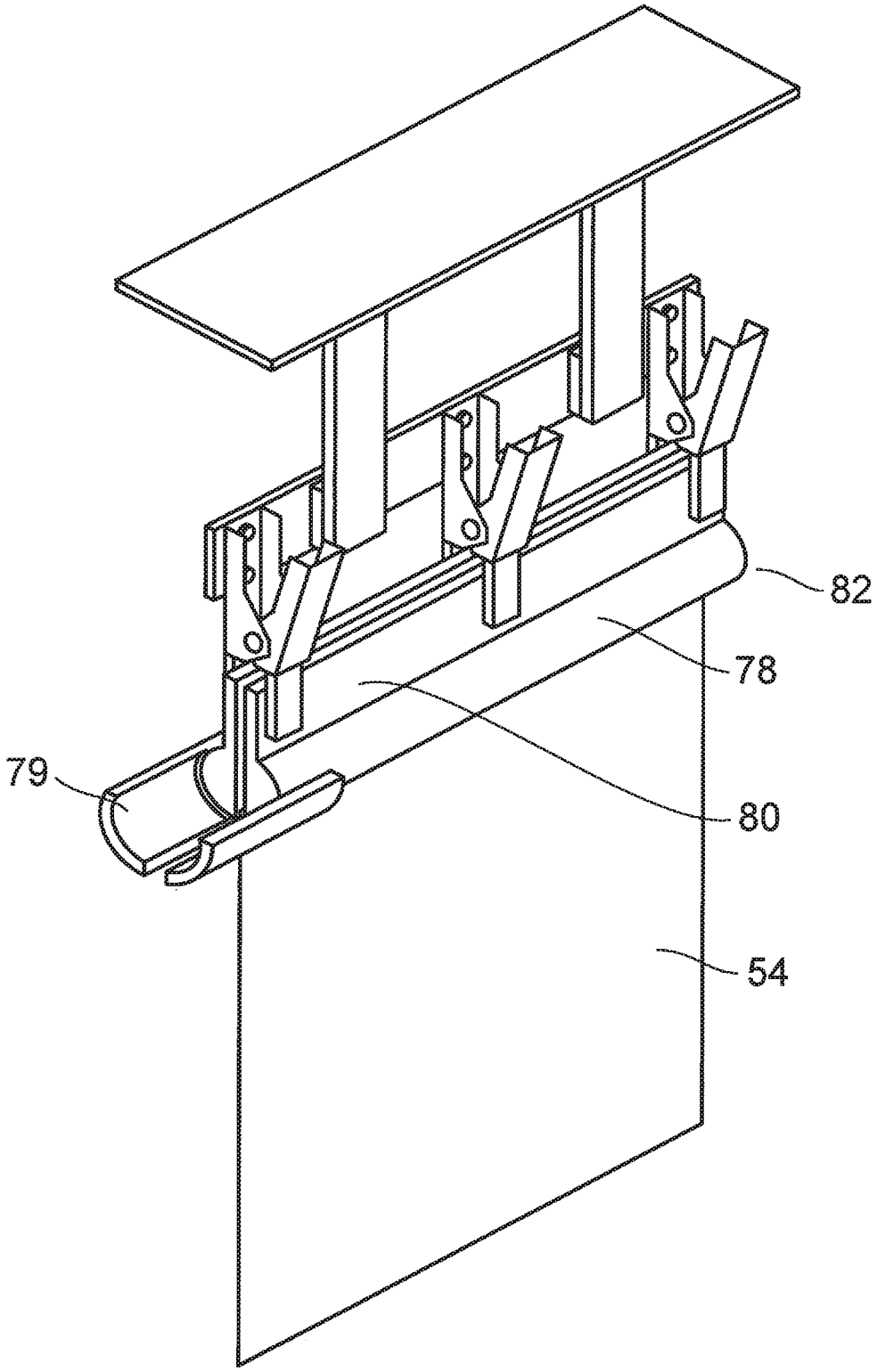
FIG. 16 is a diagram illustrating the state of the hanger 50 provided with guide members 79.
Figure 17C:
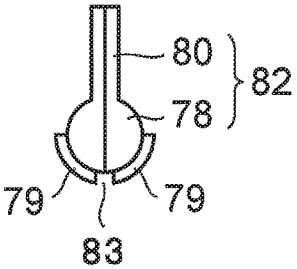
FIG. 17A, FIG. 17B and FIG. 17C are diagrams illustrating details of the guide members 79.
Figure 17A:
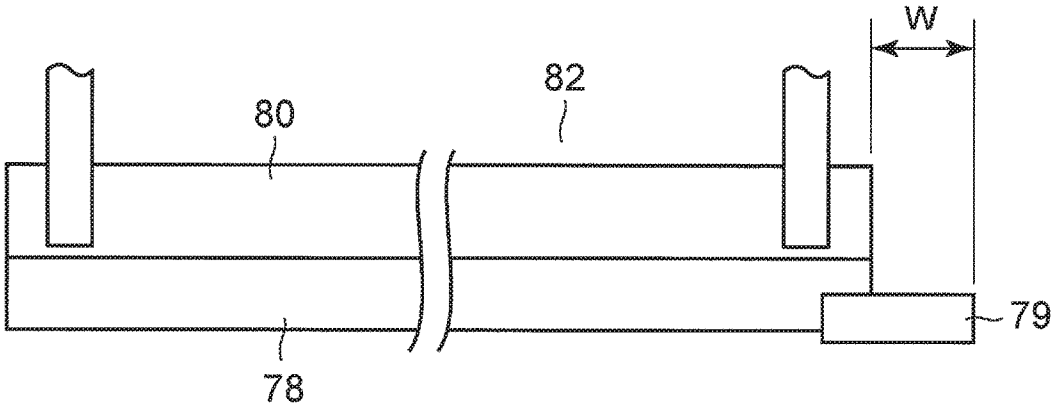
Figure 17B:
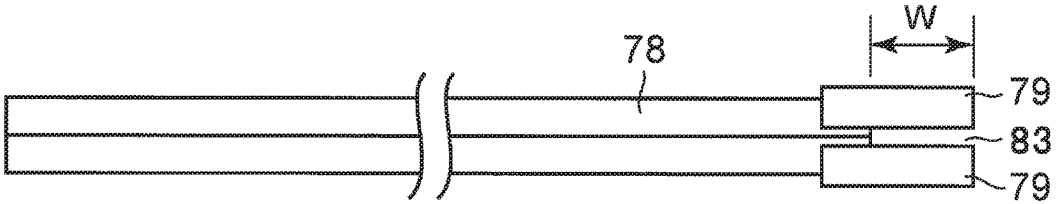

In FIG. 16, a guide member 79 is provided on the projected section 78 of each treatment solution receiving member 82. FIG. 17A shows a front view thereof, FIG. 17B shows a bottom view thereof, and FIG. 17C shows a side view thereof.

The guide members 79 are formed in conformity with the external shape of the projected sections 78 and provided on the outside of the projected sections 78. In this embodiment, the guide members 79 are provided to extend along the curve of lower halves of the projected sections 78. The guide members 79 do not cover the lower side of the projected sections 78 completely but are provided to form a space 83 at a lower end. In addition, the guide members 79 are provided to protrude by W from the width of the projected sections 78.

Figure 18:
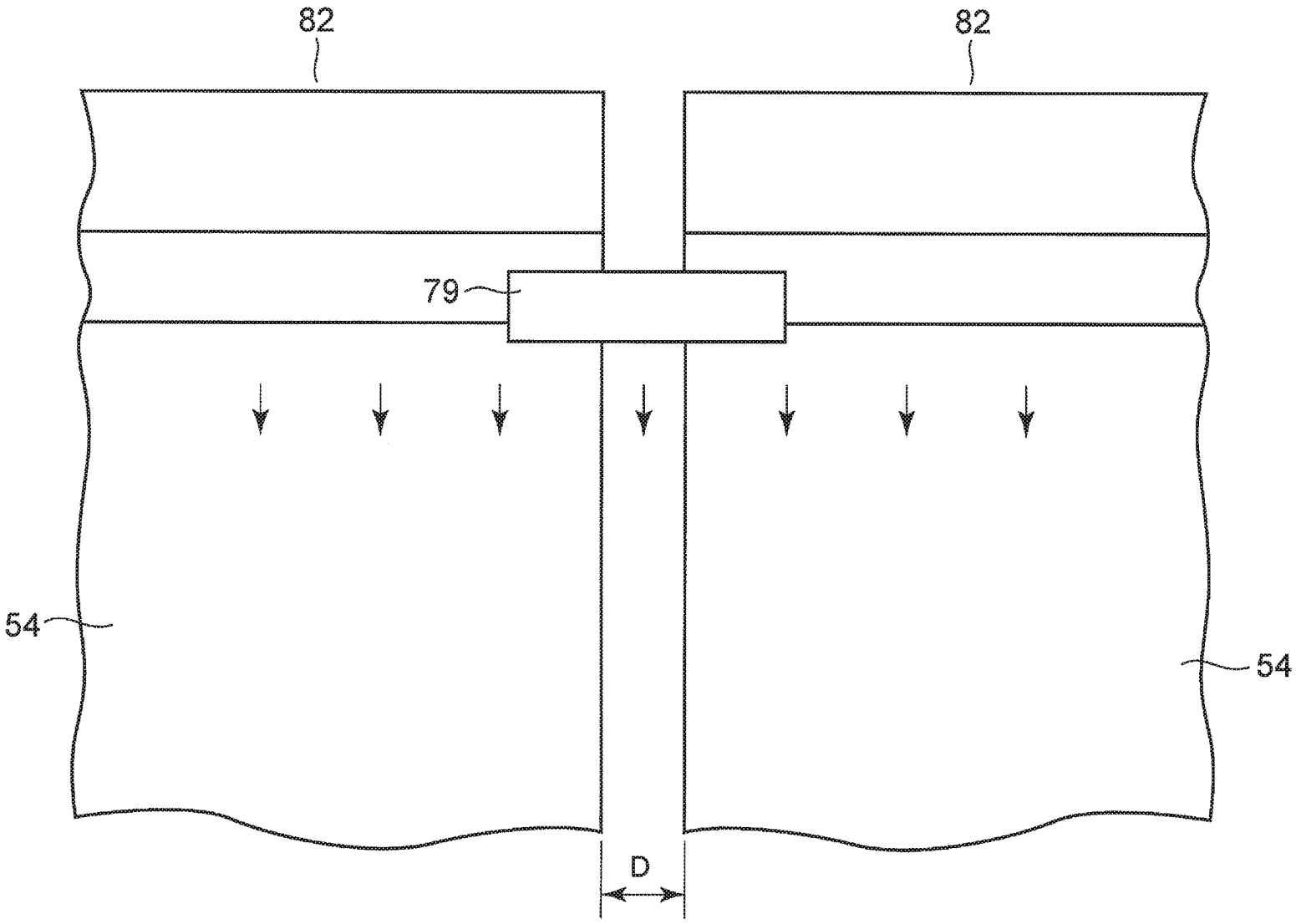
FIG. 18 is a diagram for explaining the function of the guide members 79.

FIG. 18 shows a state of two adjacent treatment solution receiving members 82 at a time when a plurality of hangers 50 is transported. The front ends of the downstream (right) treatment solution receiving members 82 have been placed on the guide members 79 provided at the rear ends of the upstream (left) treatment solution receiving members 82. In addition, a front end of the downstream (right) substrate 54 has been inserted into the space 83 (refer to FIG. 17C) between the upstream (left) guide members 79. As a result, the front end of the downstream (right) substrate 54 overlaps a part of the adjacent upstream (left) guide members 79. At this time, the treatment solution receiving members 82 of the hangers 50 and the substrates 54 are transported with a predetermined gap D (in this embodiment, 5 mm to 15 mm) therebetween. In this case, a portion of the treatment solution discharged from the pipes 56 is received by the guide members 79 and allowed to fall through the space 83 (refer to FIG. 17C) into the gap D. Thus, a film of treatment solution is formed in the part of the gap D, and the problem as shown in FIG. 14 can be avoided. As a result, surface treatment with less non-uniformity can be achieved.

As described above, with the embodiment shown in FIG. 18, surface treatment with less non-uniformity can be achieved without increasing the distance between the substrates 54. While the guide members 79 are provided only on one side of the treatment solution receiving members 82 in the above example, hangers 50 provided with the guide members 79 on both sides and hangers 50 without the guide members 79 may be arranged alternately and used.

Figure 19C:
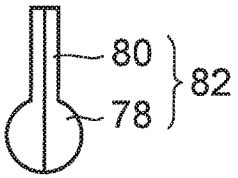
FIG. 19A, FIG. 19B and FIG. 19C are diagrams illustrating the structure of treatment solution receiving members 82 according to another example.
Figure 19A:
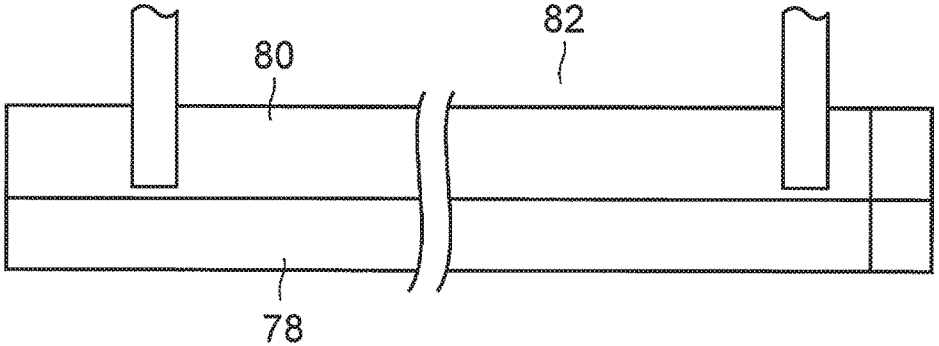
Figure 19B:
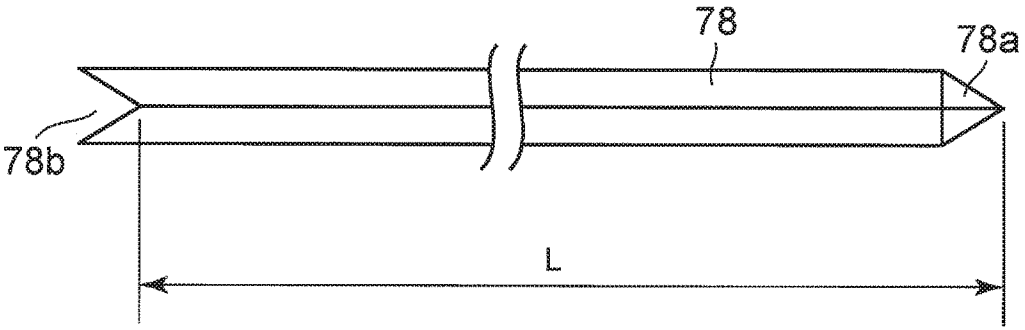

In addition, as shown in FIG. 19, the treatment solution receiving members 82 (the projected sections 78) may be beveled to an acute edge at one end to form a protrusion 78*a* and a corresponding recess 78*b* may be formed at the other end of the treatment solution receiving members 82. FIG. 19A shows a front view thereof, FIG. 19B shows a bottom view thereof, and FIG. 19C shows a side view thereof. In this case, it is recommended that the substrate 54 is attached along the entire length L in FIG. 19B. The protrusion 78*a* of each hanger 50 is received in the recess 78*b* of an adjacent hanger 50 (however, a distance of 5 mm to 15 mm is provided so that the hangers 50 do not contact each other). Thus, a layer of treatment solution flow can be also formed between the substrates 54.

In FIG. 19, the protrusion 78*a*, which has a beveled acute edge, and the recess 78*b*, which has a shape corresponding to the protrusion 78*a*, are provided. However, the protrusion 78*a* and the recess 78*b* may be of any shape as long as one of them can be received in the other. For example, a circular cylindrical protrusion 78*a* and a recess 78*b* having a shape corresponding to the protrusion 78*a* may be used.

Figure 20C:
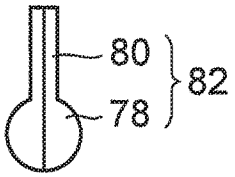
FIG. 20A, FIG. 20B and FIG. 20C are diagrams illustrating the structure of treatment solution receiving members 82 according to another example.
Figure 20A:
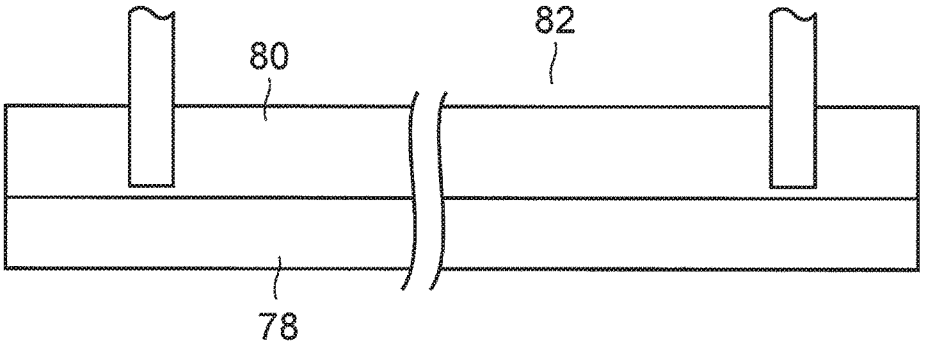
Figure 20B:
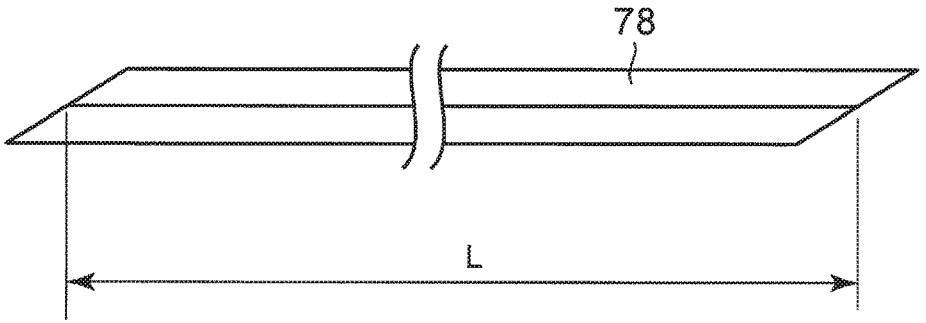

Alternatively, as shown in FIG. 20, the treatment solution receiving members 82 (the projected sections 78) may be beveled at both ends. FIG. 20A shows a front view thereof, FIG. 20B shows a bottom view thereof, and FIG. 20C shows a side view thereof.

Figure 21C:
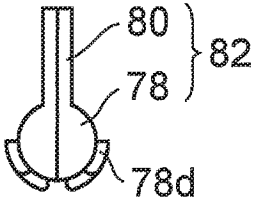
FIG. 21A, FIG. 21B and FIG. 21C are diagrams illustrating the structure of treatment solution receiving members 82 according to another example.
Figure 21A:
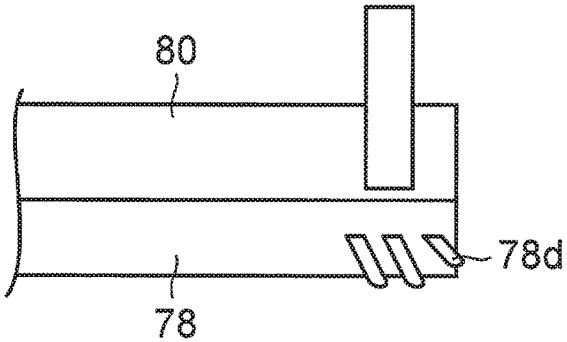
Figure 21B:
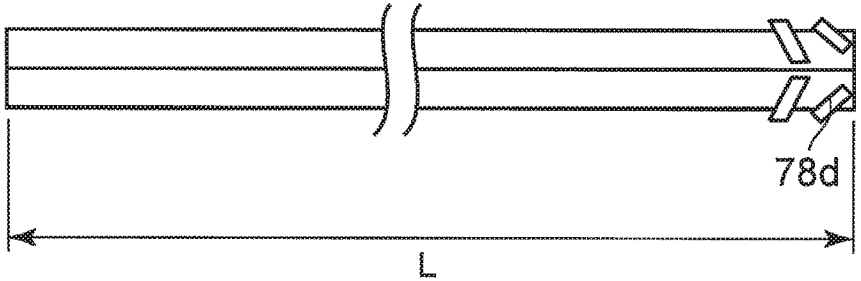

In addition, as shown in FIG. 21, protrusions 78*d* for changing the direction of flow may be provided at both ends of the treatment solution receiving members 82 (the projected sections 78). FIG. 21A shows a front view thereof, FIG. 21B shows a bottom view thereof, and FIG. 21C shows a side view thereof. In this case, the treatment solution is directed outward at both ends of the treatment solution receiving members 82 so that the treatment solution can be allowed to flow into the space between the substrates 54.

While thin substrates (with a thickness of several dozen μm) that cannot stand on their own in a natural state are described as targets of treatment in the above embodiments. However, thicker plates can be employed as targets of treatment.

While the second embodiment can be implemented in combination with the first embodiment, it can be also implemented on its own independently of the first embodiment.

A general description of the present invention as well as preferred embodiments of the invention has been set forth above. It is to be expressly understood, however, the terms described above are for purpose of illustration only and are not intended as definitions of the limits of the invention. Those skilled in the art to which the present invention pertains will recognize and be able to practice other variations in the system, device, and methods described which fall within the teachings of this invention. Accordingly, all such modifications are deemed to be within the scope of the invention.

What is claimed is:

1. A surface treating apparatus, comprising:

outer walls, a holding member for holding an upper part of a treatment target;

a treatment bath in which a treatment target held by the holding member is immersed in a treatment solution;

an upper supporting member for supporting the holding member from above;

a transferring mechanism for moving the upper supporting member; and protective members provided at least below the transferring mechanism and connected to respective outer walls, wherein the upper supporting member is located between the outer walls and supports the holding member with at least a portion of the upper supporting member being located above the protective members.

2. The surface treating apparatus according to claim 1, further comprising additional protective members provided on both sides of the transferring mechanism.

3. The surface treating apparatus according to claim 2, wherein a liquid is filled in a space defined by the protective members so that a lower part of the transferring mechanism or at least a part of the transferring mechanism can be immersed in the liquid.

4. The surface treating apparatus according to claim 3, wherein a water supply port and a water drain port are provided in the space defined by the protective members so that the liquid can be replaced.

5. The surface treating apparatus according to claim 3, wherein the transferring mechanism is formed of stainless, titanium, carbon steel, brass or plastic.

6. A surface treating apparatus comprising:

at least one clip configured to hold an upper part of a treatment target;

a treatment bath in which a treatment target held by the at least one clip is immersed in a treatment solution;

a top plate, a hanging plate, a clip holder and a clip all interconnected and configured to support the treatment target from above;

a transferring assembly including one or more of: rollers, roller guides, pinions and a rack, connected to and configured to move the top plate, the hanging plate, the clip holder and the clip; and one or more protective walls provided at least below the transferring assembly, wherein the top plate is above the one or more protective walls and between outer walls of the surface treating apparatus.

7. The surface treating apparatus according to claim 6, further comprising additional protective walls provided on both sides of the transferring assembly.

8. The surface treating apparatus according to claim 7, wherein a liquid is filled in a space defined by the protective walls so that a lower part of the transferring assembly or at least a part of the transferring assembly is immersed in the liquid.

9. The surface treating apparatus according to claim 8, wherein a water supply port and a water drain port are provided in the space defined by the protective walls.

10. The surface treating apparatus according to claim 8, wherein the transferring assembly is formed of stainless, titanium, carbon steel, brass or plastic.

11. A surface treating apparatus comprising:

outer walls;

at least one clip configured to hold an upper part of a treatment target;

a treatment bath in which the treatment target held by the at least one clip is immersed in a treatment solution;

a top plate, a hanging plate, a clip holder and a clip all interconnected and configured to support the treatment target from above;

a transferring assembly including one or more: rollers, roller guides, pinions and a rack, connected to and configured to move the top plate, the hanging plate, the clip holder, the clip and the treatment target; and one or more protective walls provided at least partially below the transferring assembly through which at least a portion of the hanging plate passes therebetween, the one or more protective walls connected to the outer walls and configured to form a reservoir to hold a liquid into which a portion of the rollers reside, wherein the top plate is above the one or more protective walls and between the outer walls of the surface treating apparatus.

* * * * *